US011619897B2

(12) United States Patent
Ishida et al.

(10) Patent No.: US 11,619,897 B2
(45) Date of Patent: Apr. 4, 2023

(54) IMAGE FORMING APPARATUS

(71) Applicant: BROTHER KOGYO KABUSHIKI KAISHA, Nagoya (JP)

(72) Inventors: Miho Ishida, Nagoya (JP); Shintaro Fukuoka, Nagoya (JP); Toshio Furukawa, Nagoya (JP); Toshinori Araki, Hekinan (JP); Masaya Takasu, Tokai (JP); Takuro Nishimura, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/831,768

(22) Filed: Jun. 3, 2022

(65) Prior Publication Data

US 2022/0397852 A1 Dec. 15, 2022

(30) Foreign Application Priority Data

Jun. 15, 2021 (JP) ..... JP2021-099096
Aug. 20, 2021 (JP) ..... JP2021-134818

(51) Int. Cl.
*G03G 15/00* (2006.01)
*G03G 15/08* (2006.01)
*G03G 15/01* (2006.01)

(52) U.S. Cl.
CPC ..... *G03G 15/5041* (2013.01); *G03G 15/0121* (2013.01); *G03G 15/0855* (2013.01); *G03G 2215/00063* (2013.01)

(58) Field of Classification Search
CPC ..... G03G 15/5041; G03G 15/0121; G03G 15/0855; G03G 2215/00063
See application file for complete search history.

(56) References Cited

U.S. PATENT DOCUMENTS 3,799,668 A * 3/1974 McVeigh ..... G03G 15/01 250/252.1
2012/0274986 A1 11/2012 Harashima et al.
2017/0269527 A1* 9/2017 Kaneko ..... G03G 15/5025

FOREIGN PATENT DOCUMENTS

JP 9-6124 A 1/1997
JP 2005-352366 A 12/2005
JP 2012-230312 A 11/2012
JP 2020-3637 A 1/2020

* cited by examiner

*Primary Examiner* — Susan S Lee
(74) *Attorney, Agent, or Firm* — Merchant & Gould P.C.

(57) ABSTRACT

In an image forming apparatus, an image forming unit configured to form a toner image on a transfer medium includes four sets of a photoconductor drum and a development roller, respectively, for forming toner images of first, second, third and fourth colors, arranged in this order, in a direction opposite to a direction of movement of the transfer medium moving toward a detector configured to detect a toner image formed on the transfer medium. A controller executes a bias-corrective test image forming process in which a first bias-corrective test image of the first color is arranged in a position downstream of other three first bias-corrective test images, and a second bias-corrective test image of the first color is arranged in a position between two first bias-corrective test images selected among other three first bias-corrective test images, in the direction of movement of the transfer medium.

18 Claims, 13 Drawing Sheets

PRINT PATTERN IMAGE

51K(51)
PnK(Pn)
61K(61)
51C
PnC
61C
51M
PnM
61M
51Y
PnY
61Y
Y1
M1
Y2
M2
71
72
73
Pr
PS

51K
K1
Y1
M1
51C
C1
Y2
M2
51M
51Y

51K
M1
Y1
K2
C1
51C
Y2
M2
C2
51M
51Y
K1

IMAGE FORMING APPARATUS

CROSS-REFERENCE TO RELATED APPLICATION(S)

This application claims priority from Japanese Patent Applications No. 2021-099096 filed on Jun. 15, 2021 and No. 2021-134818 filed on Aug. 20, 2021, the disclosures of which are incorporated herein by reference in their entirety.

TECHNICAL FIELD

Apparatuses disclosed herein relate generally to image forming apparatuses, and more particularly to an image forming apparatus with a controller configured to execute a process of making a print density adjustment, or the like, based on an output of a detector which detects an image formed on a transfer medium such as a belt.

BACKGROUND ART

An image forming apparatus may comprise an image forming unit configured to form a multicolor toner image on a transfer medium, a detector configured to detect a toner image formed on the transfer medium, and a controller configured to execute several processes which include a bias-corrective test image forming process, a bias setting process and a pattern image forming process. In the bias-corrective test image forming process, a first bias-corrective test image is formed on the transfer medium with a first developing bias being applied to a development roller, and then a second bias-corrective test image is formed on the transfer medium with a second developing bias (having a value different from that of the first developing bias) being applied to the development roller. In the bias setting process, a developing bias is set based on outputs of the detector as generated upon detection of the first bias-corrective test image and the second bias-corrective test image. In the pattern image forming process, a plurality of pattern images are formed on the transfer medium with the developing bias (set in the bias setting process) being applied to the development roller.

The image forming apparatus may comprise four photoconductor drums for four colors of black (K), cyan (C), magenta (M), and yellow (Y). The photoconductor drums for K, C, M, and Y are arranged in this order, in positions upstream of the detector along a path of movement of the transfer medium, from a position closest to the detector in a direction away from the detector.

An image forming apparatus may comprise a belt as a transfer medium on which a patch (test image) of toner can be formed. Herein, the print density of the patch formed on the belt may be detected by the detector. In some cases, the leading-edge and trailing-edge regions of the patch, which would be liable to possible instability in print density due to edge effect caused by electric field in their vicinities, may not be detected by the detector, i.e., only a center region thereof between the leading-edge and trailing-edge regions may be detected by the detector, so that the print density of the patch can be detected precisely.

SUMMARY

In the bias-corrective test image forming process and the pattern image forming process, the images formed on the transfer medium may be arranged typically in orderly sequence of colors Y, M, C, K from a position closest to the detector in a direction away from the detector, (i.e., opposite to the direction of movement of the transfer medium). In this arrangement, the image of black color (K) formed at the photoconductor drum closest to the detector is detected by the detector at a time later than times at which the images of the other colors are detected by the same detector. This would disadvantageously require extra time to be expended from the start of the bias-corrective test image forming process until the completion of the pattern image forming process.

In this context, there is a need for a contrivance to save time to be expended from the start of the bias-corrective test image forming process until the completion of the pattern image forming process.

In one aspect, an image forming apparatus comprising an image forming unit, a detector and a controller is disclosed. The image forming unit is configured to form a toner image on a transfer medium. The image forming unit comprises four sets of a photoconductor drum and a development roller; the four sets consists of a first set for forming a toner image of a first color, a second set for forming a toner image of a second color, a third set for forming a toner image of a third color, and a fourth set for forming a toner image of a fourth color. The photoconductor drums for the first, second, third and fourth colors are arranged in this order, in a direction opposite to a direction of movement of the transfer medium moving toward the detector. The detector is configured to detect a toner image formed on the transfer medium passing by the detector.

The controller is capable of executing, for each of the first color, the second color, the third color, and the fourth color: a bias-corrective test image forming process of causing the image forming unit to form a first bias-corrective test image on the transfer medium with a first developing bias being applied to the development roller, and to form a second bias-corrective test image on the transfer medium with a second developing bias being applied to the development roller, the second developing bias having a value different from a value of the first developing bias; and a bias setting process of setting a developing bias based on outputs of the detector as generated upon detection of the first bias-corrective test image and the second bias-corrective test image.

The controller is configured to execute the bias-corrective test image forming process in such a manner that a first bias-corrective test image of the first color is arranged in a position downstream of other three first bias-corrective test images of the second, third, and fourth colors in the direction of movement of the transfer medium, and a second bias-corrective test image of the first color is arranged in a position between two first bias-corrective test images selected among other three first bias-corrective test images of the second, third, and fourth colors in the direction of movement of the transfer medium.

The controller may, alternatively, be configured to execute the bias-corrective test image forming process and the pattern image forming process in such a manner that: a color of a frontmost first bias-corrective test image that is located frontmost among a first set of images consisting of the first bias-corrective test images of respective colors and the second bias corrective test images of the respective colors, and a color of a frontmost pattern image that is located frontmost among a second set of images consisting of the pattern images of the respective colors are the first color; and a color of a rearmost second bias-corrective test image that is located rearmost among the first set of images and a color of a rearmost pattern image that is located rearmost among the second set of images are different from each other.

If a patch (test image) is formed in a predetermined region on the photoconductor drum and another patch is formed on the same predetermined region before the photoconductor drum has made one full rotation, the previous patch formation affects the subsequent patch formation, with the result that the subsequently formed patch could not be formed clearly. To address this problem, a succeeding patch (formed subsequent to a preceding patch) may be formed in a region apart, upstream in a direction of movement of the belt, from a preceding patch formed region with a spacing (pitch) equivalent to a total length of a circumferential length of the photoconductor drum and a length of the preceding patch formed region. However, such arrangement of the succeeding patch would disadvantageously limit the degree of flexibility in arrangement of the patches.

The same problem may arise in relation to the development roller. To be more specific, if toner carried on a predetermined region of the development roller is supplied onto the photoconductor drum to form a patch on the photoconductor drum and toner is supplied again from the same predetermined region of the development roller onto the photoconductor drum before the photoconductor drum has made one full rotation, the toner carried on the predetermined region would be insufficient for patch formation, with the result that the subsequently formed patch could not be formed clearly. To address this problem, a succeeding patch (formed subsequent to a preceding patch) may be formed in a region apart from a preceding patch formed region at a distance equivalent to a total length of a circumferential length of the development roller and a length of the preceding patch formed region, upstream in a direction of movement of the belt. However, such arrangement of the succeeding patch would disadvantageously limit the degree of flexibility in arrangement of the patches.

In this context, there is a need for a contrivance to impart greater flexibility to the arrangement of the patches.

In view of the circumstances, an image forming apparatus in another aspect is disclosed herein, which comprises an image forming unit, a detector, and a controller. The image forming unit comprises a photoconductor drum, a development roller and a belt. The image forming unit is configured to form a patch of toner of a predetermined color on the belt by transferring the patch from the photoconductor drum onto the belt. The detector is configured to detect the patch formed on the belt.

The controller is configured to cause the image forming unit to form a preceding patch of the predetermined color on the belt and thereafter form a succeeding patch of the predetermined color on the belt in a position distanced, upstream in the direction of movement of the belt, from the preceding patch, in such a manner that the succeeding patch consists of a first part and a second part, the first part extending over a first region defined between a first position apart upstream from a leading edge of the preceding patch at a distance equal to a drum circumferential length that is a circumferential length of the photoconductor drum and a second position apart upstream from a trailing edge of the preceding patch at the distance equal to the drum circumferential length, and a leading edge or a trailing edge of the succeeding patch is located in the first region, while the second part is located outside the first region. Herein, the first part of the succeeding patch which extends over the first region has a length Lo in the direction of movement of the belt, the length Lo being equal to or shorter than 3 millimeters.

The controller may, alternatively, be configured to cause the image forming unit to form a preceding patch of the predetermined color on the belt and thereafter form a succeeding patch of the predetermined color on the belt in a position distanced, upstream in the direction of movement of the belt, from the preceding patch, in such a manner that the succeeding patch consists of a first part and a second part, the first part extending over a second region defined between a third position apart upstream from a leading edge of the preceding patch at a distance equal to a roller circumferential length that is a circumferential length of the development roller and a fourth position apart upstream from a trailing edge of the preceding patch at the distance equal to the roller circumferential length, and a leading edge or a trailing edge of the succeeding patch is located in the first region, while the second part is located outside the second region. Herein, the first part of the succeeding patch which extends over the second region has a length Lo in the direction of movement of the belt, the length Lo being equal to or shorter than 3 millimeters.

A patch forming method implemented by the controller of the image forming apparatus is also disclosed herein.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

Figure 1:
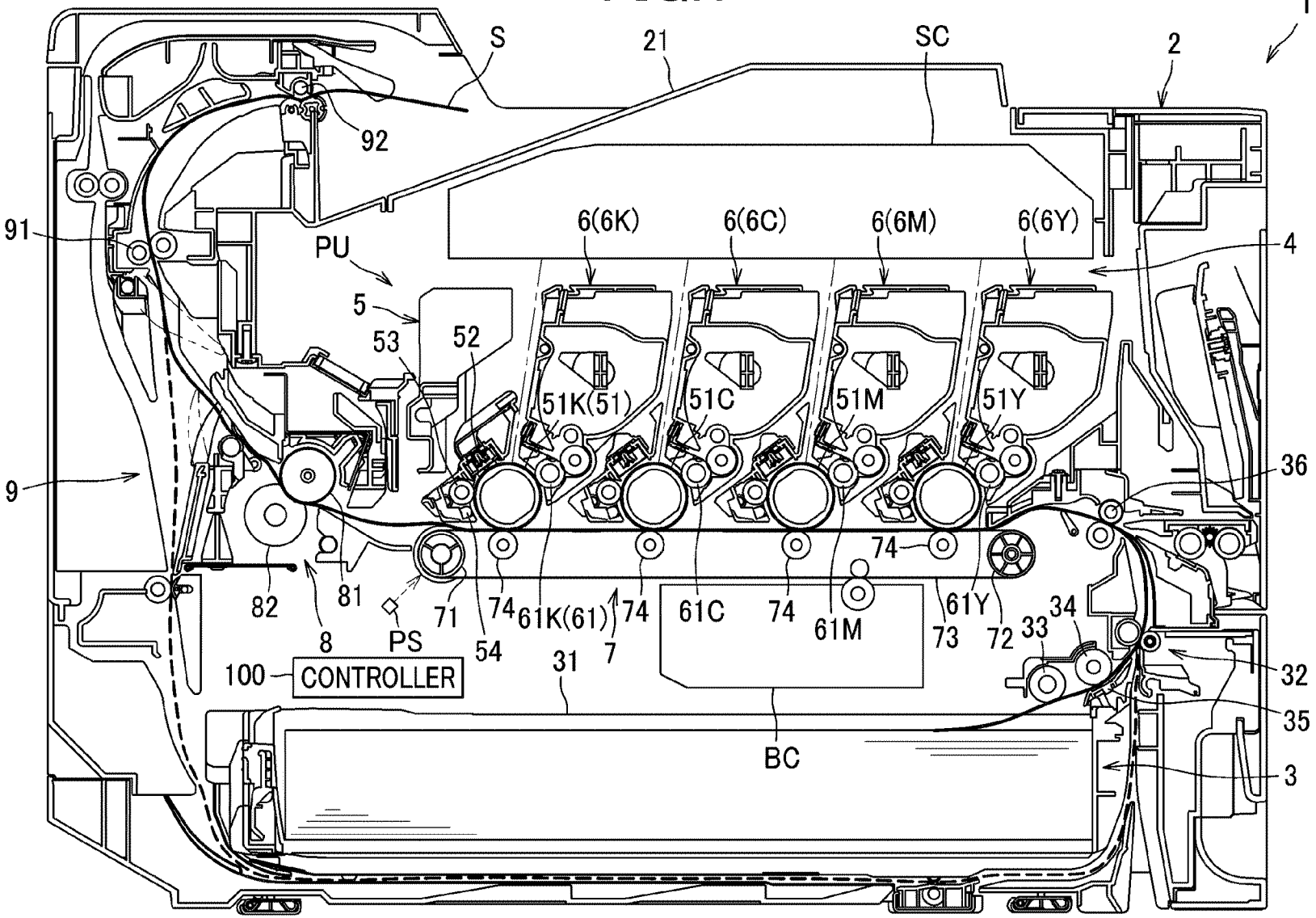
FIG. 1 is a section view of a printer.

As shown in FIG. 1, a color printer 1 as an example of an image forming apparatus includes a housing 2, a sheet feeder unit 3, an image forming unit 4, a detector PS, a fixing device 8, a conveyor unit 9, and a controller 100. The housing 2 includes a sheet output tray 21 provided in an upper surface thereof.

The sheet feeder unit 3 is provided in a lower space inside the housing 2, and includes a sheet feed tray 31 configured as a receptacle to hold and serve sheets S, and a sheet feed mechanism 32 configured to feed a sheet S held in the sheet feed tray 31, into the image forming unit 4. The sheet feed mechanism 32 includes a pickup roller 33, a separation roller 34, a separation pad 35, and a registration roller 36.

In the sheet feeder unit 3, sheets S in the sheet feed tray 31 are fed by the pickup roller 33 toward the separation roller 34, and separated one from the others between the separation roller 34 and the separation pad 35. The registration roller 36 aligns the edge of the sheet S and conveys the sheet S toward the image forming unit 4.

The image forming unit 4 includes an exposure device SC, a process unit PU, and a transfer unit 7.

The exposure device SC is provided in an upper space inside the housing 2, and includes a light source, a polygon mirror and other components which are not illustrated. The exposure device SC is configured to scan a surface of each photoconductor drum 51 with a light beam, to thereby expose the surface of the photoconductor drum 51 to the light beam.

The process unit PU includes a drawer 5 and four development cartridges 6. The drawer 5 is configured to be drawable from the housing 2. The drawer 5 includes four sets of a photoconductor drum 51, a charger 52, a drum cleaner 53, and a static eliminator lamp 54.

The charger 52 is a member that charges a surface of the photoconductor drum 51. When the charged surface of the photoconductor drum 51 is exposed to a light beam by the exposure device SC, an electrostatic latent image, as formulated according to image data, is formed on the surface of the photoconductor drum 51. The drum cleaner 53 is a member that cleans the surface of the photoconductor drum 51. The static eliminator lamp 54 is a member that irradiates the surface of the photoconductor drum 51 with light to thereby eliminate static electricity.

The development cartridges 6 contain toner. Each development cartridge 6 includes a development roller 61 that supplies toner to an electrostatic latent image on the photoconductor drum 51 to form an image, i.e., a toner image, on the photoconductor drum 51.

The development cartridges 6, designated respectively by reference characters 6K, 6C, 6M and 6Y, for containing toner of corresponding colors of black, cyan, magenta and yellow are arranged in this order, in a direction opposite to a direction of conveyance of a sheet S (i.e., in the upstream direction from the last one located downstream of the penultimate one to the first one located upstream of the second one). In other words, the development cartridges 6K, 6C, 6M and 6Y are arranged in this order in a direction opposite to a direction of movement of a conveyor belt 73 (which will be described later) moving toward the detector PS. Similarly, the photoconductor drums 51 for K (black), C (cyan), M (magenta), and Y (yellow) are arranged in this order in the direction opposite to the direction of movement of the conveyor belt 73 moving toward the detector PS. In the following description and associated drawings, when the photoconductor drums 51, the development rollers 61 or other members are specified for respective colors of toner, signs of K, C, M, and Y are appended to reference characters of the respective members for black, cyan, magenta, and yellow, and the "first", "second", "third", and "fourth" are prefixed to the legends of the corresponding members for the respective colors (black, cyan, magenta, and yellow).

For example, the photoconductor drum 51 and the development roller 61 for black color will also be referred to as the first photoconductor drum 51K and the first development roller 61K. The photoconductor drum 51 and the development roller 61 for cyan color will also be referred to as the second photoconductor drum 51C and the second development roller 61C. The photoconductor drum 51 and the development roller 61 for magenta color will also be referred to as the third photoconductor drum 51M and the third development roller 61M. The photoconductor drum 51 and the development roller 61 for yellow color will also be referred to as the fourth photoconductor drum 51Y and the fourth development roller 61Y. In the present embodiment, black corresponds to the first color, cyan corresponds to the second color, magenta corresponds to the third color, and yellow corresponds to the fourth color.

The transfer unit 7 includes a drive roller 71, a follower roller 72, a conveyor belt 73 as an example of a belt or an example of a transfer medium, four transfer rollers 74, and a belt cleaner BC. The conveyor belt 73 is an endless belt. The drive roller 71 and the follower roller 72 are members for causing the conveyor belt 73 to rotate. The drive roller 71 is located downstream of the follower roller 72 in a direction of conveyance of a sheet S.

The transfer roller 74 is a member for transferring an image on the photoconductor drum 51 onto a sheet S or the conveyor belt 73. Each transfer roller 74 is located inside the conveyor belt 73, and configured to nip the conveyor belt 73 in combination with a corresponding photoconductor drum 51 (i.e., the conveyor belt 73 is nipped between the transfer roller 74 and the photoconductor drum 51.

The belt cleaner BC has a function of cleaning toner from the conveyor belt 73. The belt cleaner BC and the photoconductor drum 51 are located on opposite sides of the conveyor belt 73.

The detector PS is a sensor configured to detect print density of a test image formed on the conveyor belt 73. The detector PS is so located as to face a surface of the conveyor belt 73 looped around the drive roller 71. The detector PS is a reflective photosensor including a light-emitting element such as a light-emitting diode or LED, and a light-receptive element such as a phototransistor, and is configured to emit light onto an image on the conveyor belt 73 to detect reflected light.

The fixing device 8 is a device configured to thermally fix a toner image on a sheet S. The fixing device 8 includes a heating roller 81 configured to heat a sheet S, and a pressure roller 82 configured to press and nip a sheet S in combination with the heating roller 81.

The conveyor unit 9 is, principally, configured to convey a sheet S outputted from the fixing device 8 toward the outside of the housing 2. The conveyor unit 9 mainly includes a conveyor roller 91, and an output roller 92. A sheet S outputted from the fixing device 8 is conveyed by the conveyor roller 91 to the output roller 92, and ejected by the output roller 92 onto an output tray 21.

The controller 100 includes a central processing unit (CPU), a read-only memory (ROM), a random access memory (RAM), etc., and is configured to execute various processes, in response to receipt of a printing instruction, or the like, according to programs prepared in advance.

Figure 2:
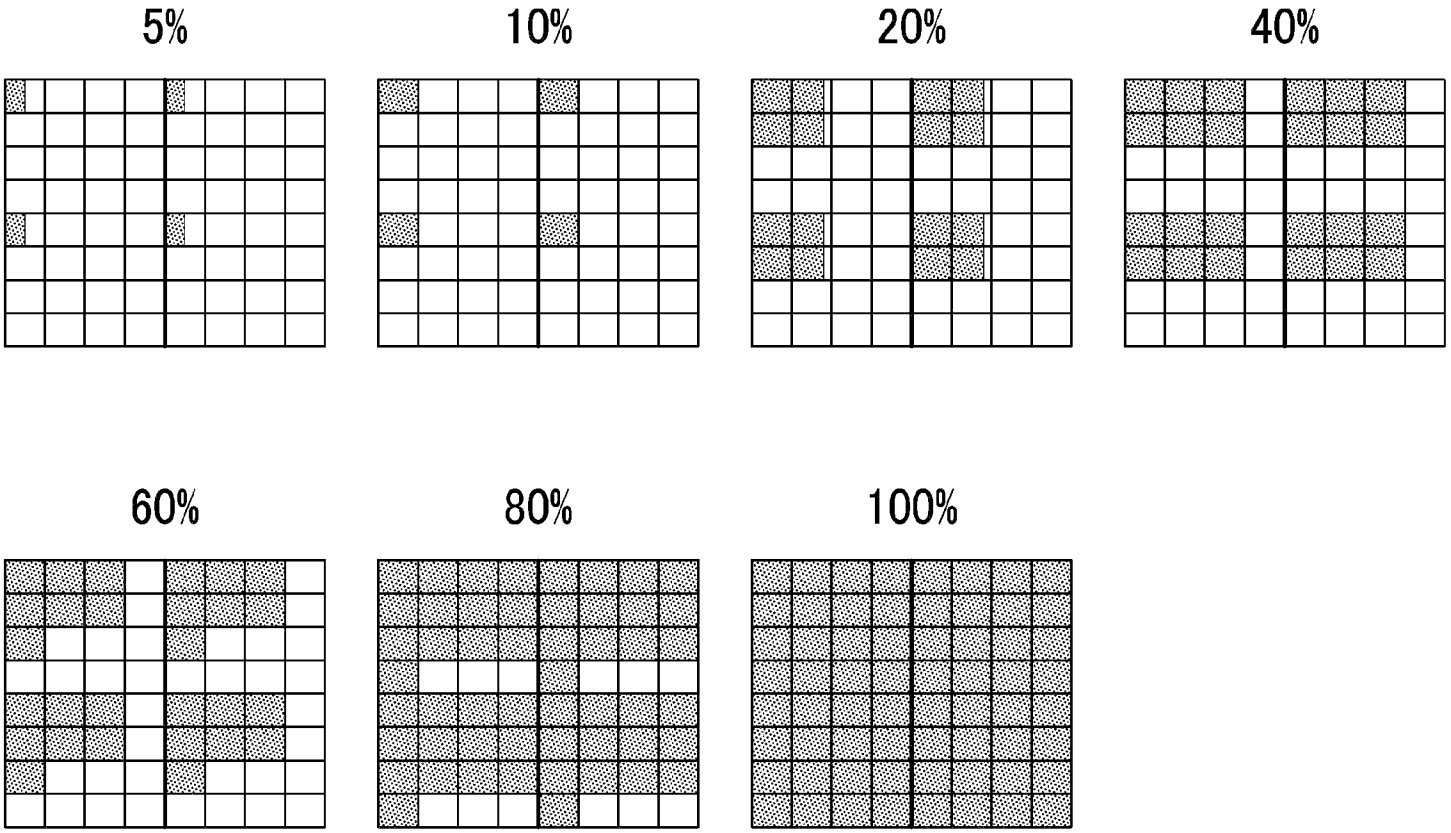
FIG. 2 is a diagram showing print pattern images.

The controller 100 has a function of executing a printing process of forming an image on a sheet S based on a print job outputted from a computer (not shown). The controller 100 executes, in the printing process, an exposure process of exposing the photoconductor drums 51 to light based on a print pattern image that is a binary image. To be more specific, in the printing process, to form an image on a sheet S, the controller 100 chooses one print pattern image from among a plurality of print pattern images having exposure pixel densities (tones) different from one another for the exposure process so that the print density of the image to be formed on the sheet S is adjusted to a predetermined target print density. The print pattern image is composed of a binary image as shown in FIG. 2. The exposure pixel density is a per-area percentage of pixels to be plotted by exposure in the print pattern image.

Herein, the print density refers to a density of a toner image developed by the development roller 61, as detected by the detector PS. The target print density refers to a target density as specified in the printing instruction. For example, if the target print density specified in the printing instruction is 20%, the controller 100 chooses a print pattern image of a pixel density of 20%, and executes an exposure process with the chosen print pattern image. In actuality, the correlation between the target print density and the exposure pixel density is subject to change by a tone setting process as will be described later. For example, when the target print density of 20% associated with the exposure pixel density of 20% is changed to be associated with the exposure pixel density of 10%, the exposure process executed in response to a printing instruction with the target print density of 20% is configured to use a print pattern image of the exposure pixel density of 10%.

The controller 100 is configured to choose one print pattern image corresponding to a target print density from among a plurality of print pattern images as described above, and execute exposure and development processes using the chosen print pattern image, so that a toner image of the target print density is formed on each photoconductor drum 51.

The plurality of print pattern images associated with the exposure pixel densities are stored beforehand in a memory (storage unit). The plurality of print pattern images for yellow, magenta, cyan, and black are stored in the memory.

The controller 100 is capable of executing an image quality adjustment process for adjusting an image quality of a toner image to be printed. The controller 100 executes the image quality adjustment process when a predetermined condition is satisfied. Specifically, for example, the controller 100 may be configured to execute the image quality adjustment process if at least one of the following conditions is satisfied:

First condition: the development cartridge 6 or the photoconductor drum 51 is brand-new;

Second condition: a user instruction for making an image quality adjustment is received;

Third condition: any of environmental factors such as temperature, humidity, etc. has changed by a predetermined degree or greater from the previous event of execution of the image quality adjustment process;

Fourth condition: the number of sheets printed has reached a predetermined number from the previous event of execution of the image quality adjustment process; and Fifth condition: a development cartridge 6 with a serial number different from that of the last-installed development cartridge has been installed.

The controller 100 has a function of executing, for each of yellow, magenta, cyan and black colors, a bias-corrective test image forming process, a bias setting process, a pattern image forming process, and a tone setting process, as sub-processes of the image quality adjustment process.

The bias-corrective test image forming process is a process of causing the image forming unit 4 to form a first bias-corrective test image on the conveyor belt 73 with a first developing bias being applied to the development roller 61, and to form a second bias-corrective test image on the conveyor belt 73 with a second developing bias being applied to the development roller 61, the second developing bias having a value different from a value of the first developing bias. Herein, the developing bias is a bias applied to the development roller 61 by a bias application unit (not shown). The image forming apparatus 4 includes this bias application unit.

The first developing bias and the second developing bias are set at values most suitable for respective colors. The first developing bias may have a different value for each color, or the same value for a subset or all of the colors. For example, a first developing bias for black may be different from, or the same as, a first developing bias for yellow. Similarly, the second developing bias may have a different value for each color, or may have the same value for a subset or all of the colors.

The first bias-corrective test image and the second bias-corrective test image are print pattern images corresponding to a common predetermined exposure pixel density. To be more specific, a print pattern image of an exposure pixel density of 40%, for example as shown in FIG. 2, is formed by applying the first developing bias so that a first bias-corrective test image is formed. In this instance, a print pattern image of an exposure pixel density of 40% is formed by applying the second developing bias so that a second bias-corrective test image is formed.

The bias setting process is a process of setting a developing bias based on outputs of the detector PS as generated upon detection of the first bias-corrective test image and the second bias-corrective test image. In this bias setting process, the controller 100 converts an intensity of light reflected from each bias-corrective test image as detected by the detector PS into a print density, and computes a developing bias with which a print density equal to a target print density is obtained, based on two print densities and two developing biases. The developing bias to be used in the bias setting process may be set at a value most suitable for each color.

The pattern image forming process is a process of causing the image forming unit 4 to form a plurality of pattern images on the conveyor belt 73 with the developing bias set in the bias setting process being applied to the development roller 61. Herein, the plurality of pattern images refer to images (tone setting images) for setting a tone, to be used in the tone setting process. To be more specific, the plurality of pattern images are a plurality of print pattern images corresponding to a plurality of exposure pixel densities; for example, five print pattern images corresponding to exposure pixel densities of 5%, 20%, 40%, 60%, and 80% are used therefor.

The tone setting process is a process of setting a correlation between the target print density and the exposure pixel density (exposure pixel densities associated with target print densities), based on the outputs of the detector PS as generated upon detection of the plurality of pattern images. To be more specific, in this tone setting process, the controller 100 sets a correlation between the target print density and the print pattern image (print pattern images associated with target print densities), so that densities of toner images to be printed in actuality, i.e., exposure pixel densities, are associated with the target print densities.

To elaborate, the controller 100 causes the detector PS to detect a plurality of pattern images, and converts an intensity of light, reflected from each pattern image, into a print density. Thereafter, the controller 100 compares each resulting print density with a corresponding exposure pixel density, and if the print density is different from the corresponding exposure pixel density, then the controller 100 corrects the correlation between the print density and the exposure pixel density to thereby change (update) the correlation between the target print density and the print pattern image.

Figure 3:
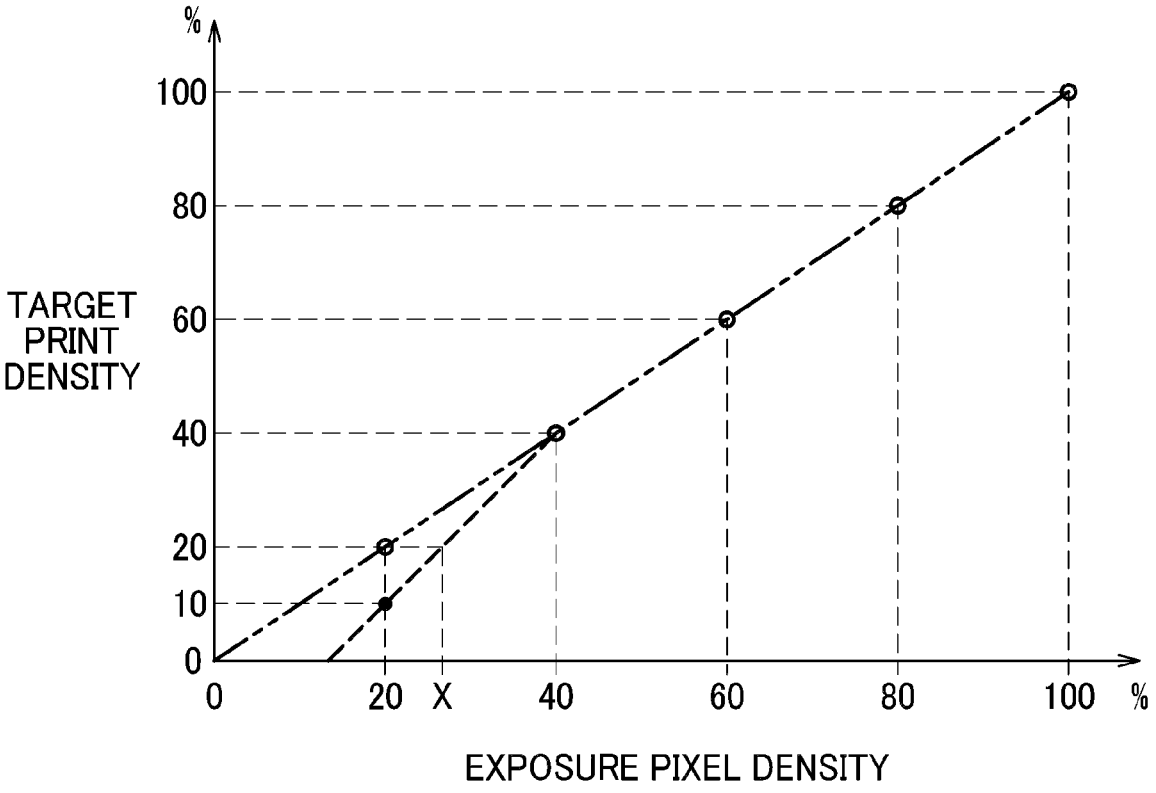
FIG. 3 is a graph showing a correlation between a target print density and an exposure pixel density associated therewith.

More specifically, if a tone setting process has never been executed before, the correlation between the target print density and the print pattern image (exposure pixel density) exhibits a default gamma table, for example, as indicated by a chain double-dashed line in FIG. 3. In the following description, the correlation between the target print density and the print pattern image will also be referred to as "gamma table".

The gamma table is a table used, when a printing process is executed, for choosing a print pattern image having a predetermined exposure pixel density corresponding to a predetermined target print density. In the gamma table indicated by the chain double-dashed line in FIG. 3, i.e., the default gamma table, the target print densities have the same values as those of the exposure pixel densities associated therewith.

In the tone setting process, for example, as indicated by a filled circle, a print pattern image formed with an exposure pixel density of 20% and detected by the detector PS may have a print density of 10% for some reason. In such cases, the controller 100 updates the gamma table and changes this print pattern image to one associated with the target print density of 10%. In other words, the controller 100 correlates the target print density of 10% with the exposure pixel density of 20% so that the target print density of 10% may be achieved in the following printing process by using a print pattern image corresponding to the exposure pixel density of 20%.

If a print pattern image formed with an exposure pixel density of 40% and detected by the detector PS in this tone setting process has a print density of 40%, i.e., the print density obtained with the exposure pixel density associated with the target print density matches with the target print density, the values in the table (exposure pixel densities associated with the target print densities) are corrected by linear interpolation as indicated by a broken line in FIG. 3. Accordingly, for example, when an image is formed with a target print density of 20% in the following printing process, a print pattern image corresponding to an exposure pixel density X specified by a point of intersection of a line of the target print density of 20% and the broken line of FIG. 3 is chosen. In this example, the gamma table to be used is a corrected one in which a segment of the default gamma table (chain double-dashed line) corresponding to a range of the exposure pixel densities lower than 40% is replaced with the broken line in FIG. 3. In short, intermediate points between the filled circle and an open circle corresponding to the exposure pixel density of 40% are interpolated as shown by the broken line in FIG. 3.

Figure 4:
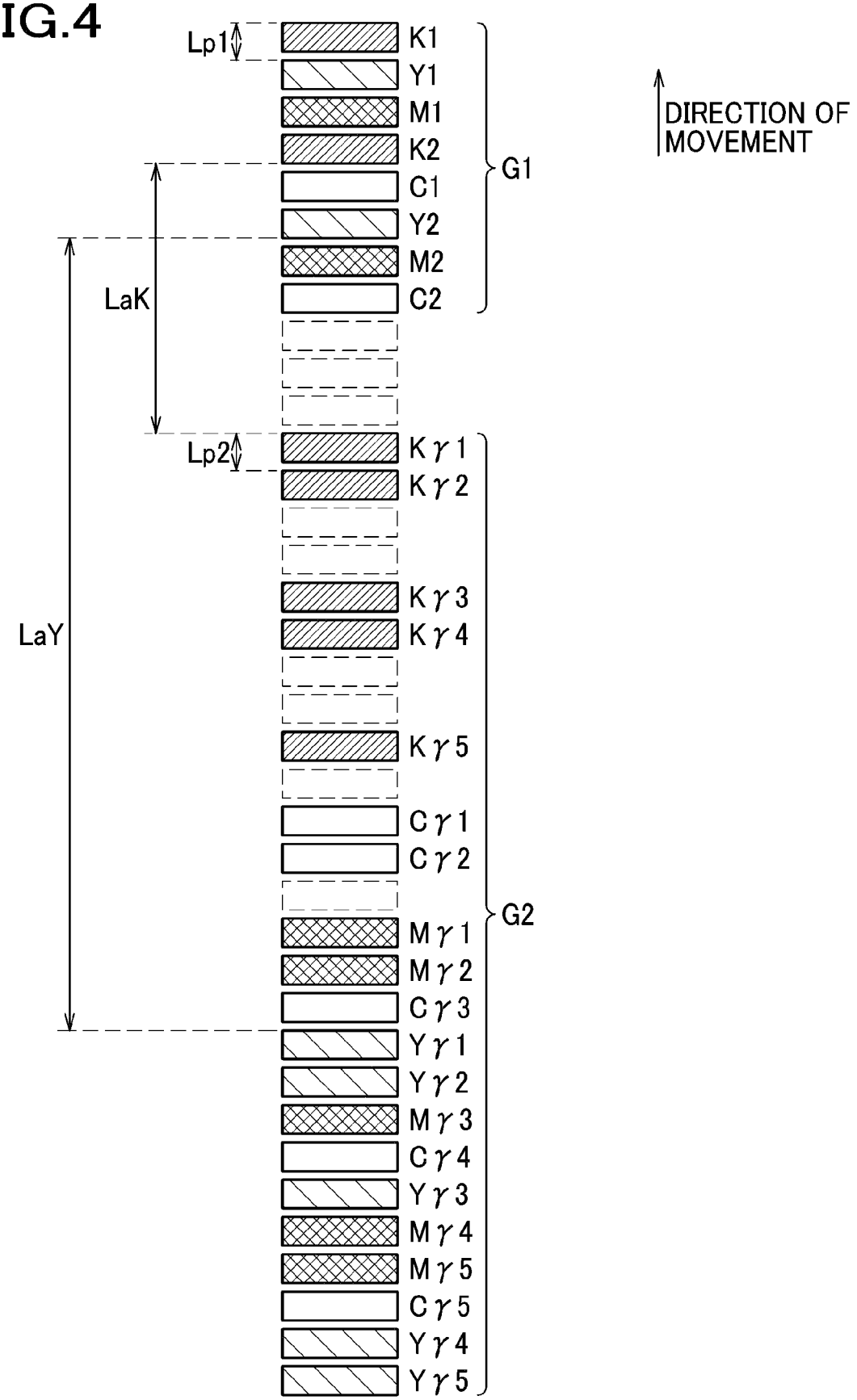
FIG. 4 is a schematic diagram for explaining the order of images to be formed on a conveyor belt.

As shown in FIG. 4, in the bias-corrective test image forming process, the controller 100 forms a first image group G1 consisting of first bias-corrective test images K1, C1, M1, Y1 for respective colors and second bias-corrective test images K2, C2, M2, Y2 for respective colors.

In the pattern image forming process, the controller 100 forms a second image group G2 consisting of pattern images Kγ1 to Kγ5, Cγ1 to Cγ5, Mγ1 to Mγ5, Yγ1 to Yγ5 for respective colors. The order of the first bias-corrective test images K1 to Y1, the second bias-corrective test images K2 to Y2, and the pattern images Kγ1 to Yγ5 on the conveyor belt 73 is predetermined as shown in FIG. 4 so that the time period to be expended from the start of the bias-corrective test image forming process to the end of the pattern image forming process is minimized. To be more specific, the order (or times) of exposures of the photoconductor drums 61 to light is determined so that the order of the test images on the conveyor belt 73 is observed as shown in FIG. 4. The order of exposures is stored in the memory or storage unit (not shown). It is to be understood that the images are illustrated in a simplified manner in FIG. 4.

The test images are arranged apart from each other in the direction of movement of the conveyor belt 73. To be more specific, the first bias-corrective test images K1 to Y1 and the second bias-corrective test images K2 to Y2 are arranged with a first pitch Lp1. Two adjacent pattern images (e.g., Kγ1 and Kγ2) of the pattern images Kγ1 to Yγ5 are arranged with a second pitch Lp2.

The length of each image in the direction of movement of the conveyor belt 73 is set according to the number of dots to be detected by the detector PS (the number of spots detectable with the resolution of the detector PS). For example, if the number of dots to be detected in the bias setting process is a first predetermined number, the length of each image of the first image group G in the direction of movement is set at a first length corresponding to the first predetermined number. If the number of dots to be detected in the tone setting process is a second predetermined number fewer than the first predetermined number, the length of each image of the second image group G2 in the direction of movement is set at a second length (shorter than the first length) corresponding to the second predetermined number. The pitches or spacings of the images are set with consideration given to variations of color displacements, reduction of the amount of toner consumption, etc.

The arrangement of the bias-corrective test images are predetermined so as to follow the order, from the frontmost image on down (rearward), i.e., in a direction opposite to the direction of movement, of K1, Y1, M1, K2, C1, Y2, M2, and C2. The controller 100 is configured to execute the bias-corrective test image forming process in such a manner that the bias-corrective test images K1, Y1, M1, K2, C1, Y2, M2, and C2 are arranged in this order in a direction opposite to the direction of movement.

The arrangement of the pattern images are predetermined so as to follow the order, from the frontmost image on down (rearward), i.e., in the direction opposite to the direction of movement, of Kγ1, Kγ2, Kγ3, Kγ4, Kγ5, Cγ1, Cγ2, Mγ1, Mγ2, Cγ3, Yγ1, Yγ2, Mγ3, Cγ4, Yγ3, Mγ4, Mγ5, Cγ5, Yγ4, and Yγ5. The pattern image Kγ3 is located apart rearward from the pattern image Kγ2 with a spacing almost equivalent of such a spacing as if measured with two empty pattern images interposed therebetween. To be more specific, the pattern image Kγ3 is located apart from the pattern image Kγ2 with a pitch of Lp2 multiplied by 3. Rephrasing of a spacing between two images by using a pitch may be made in a similar way for other kinds of images, and thus such rephrasing will be omitted in the following description.

The pattern image Kγ5 is located apart rearward from the pattern image Kγ4 with a spacing almost equivalent of such a spacing as if measured with two empty pattern images interposed therebetween. The pattern image Cγ1 is located apart rearward from the pattern image Kγ5 with a spacing almost equivalent of such a spacing as if measured with one empty pattern image interposed therebetween. The pattern image Mγ1 is located apart rearward from the pattern image Cγ2 with a spacing almost equivalent of a spacing as if measured with one empty pattern image interposed therebetween. The frontmost pattern image Kγ1 in the direction of movement is located apart rearward from the second bias-corrective test image C2 with a spacing almost equivalent of such a spacing as if measured with three empty pattern images interposed therebetween. The distance from the front edge of the frontmost first bias-corrective test image K1 to the rear edge of the rearmost pattern image Yγ5 in the direction of movement is shorter than a circumferential length of the conveyor belt 73.

The order of the test images is determined so as to fulfil the conditions described below. In the following description, the test image will also be called "patch Gp".

For the first image group G1:

1. the same color patches Gp should be arranged with a pitch equal to or greater than Lp1 multiplied by 2; and 2. the pitch between the same color patches Gp should not be Lp1 multiplied by 5.

The first condition is set for the purposes of making time required to switch the developing bias from the first developing bias to the second developing bias, and of avoiding successive development processes on the same spots of the development roller 61. In the present embodiment, it is assumed that the time required to switch the developing bias from the first developing bias to the second developing bias is approximately equivalent to the time it takes for the conveyor belt 73 to move the distance of the first pitch Lp1. Therefore, with consideration given to this first condition relating to the switching of the developing bias, the spacing between the same color patches Gp should be a spacing equal to or above the first pitch Lp1.

Successive development processes carried out on the same spots on the development roller 61 would cause the patches Gp formed thereon to smudge or smear. This phenomenon will now be discussed below with reference to FIGS. 5A, 5B and 5C. Herein, it is assumed that the length of one patch Gp in the direction of movement is approximately half the circumferential length of the development roller 61 and approximately one-sixth the circumferential length of the photoconductor drum 51.

Figure 5A:
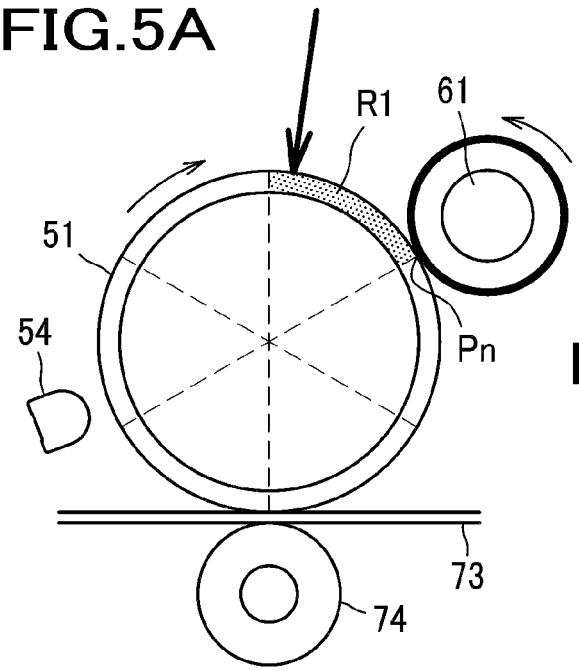
FIGS. 5A, 5B, 5C and 5D are schematic diagrams for explaining the potential problems which would be encountered when a predetermined area on a development roller is used successively for a development process, and when a predetermined area on a photoconductor drum is used successively for a development process.
Figure 5B:
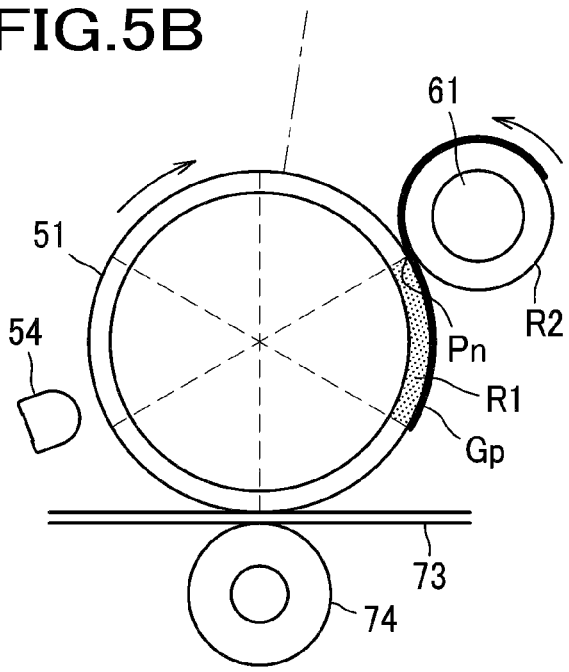
Figure 5C:
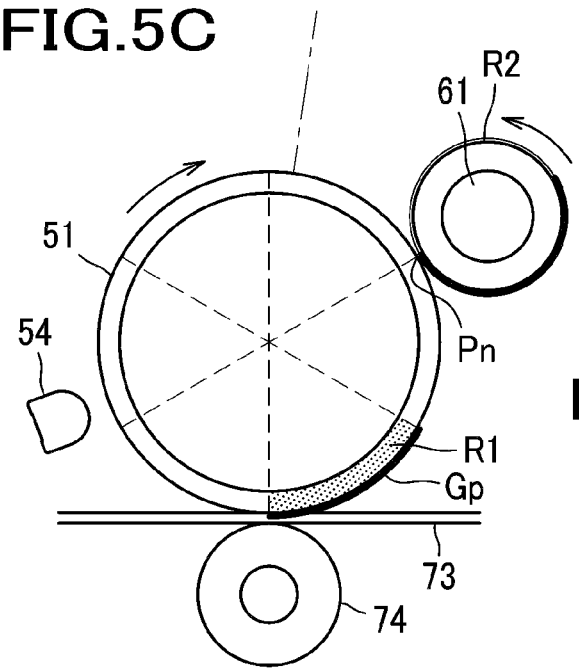

As shown in FIGS. 5A and 5B, when a first predetermined region R1 of a photosensitive surface of the photoconductor drum 51 is exposed to light, toner carried on a second predetermined region R2 of the development roller 61 is transferred to the first predetermined region R1, whereby a patch Gp is formed on the first predetermined region R1 of the photoconductor drum 51. As shown in FIG. 5C, if the development roller 61 rotates a half-turn from the position shown in FIG. 5B and the second predetermined region R2 reaches a development nip position Pn (an interface between the photoconductor drum 51 and the development roller 61) again, the amount of toner on the second predetermined region R2 would possibly be deficient. The patch Gp formed by transferring toner on the second predetermined region R2 to the photoconductor drum 51 in this situation would disadvantageously smudge or smear. On this account, the same color patches Gp should be arranged with a spacing or pitch equal to or greater than Lp1 multiplied by 2 so that two patches Gp of the same color will not be arranged with a spacing equivalent to the first pitch Lp1.

Figure 5D:
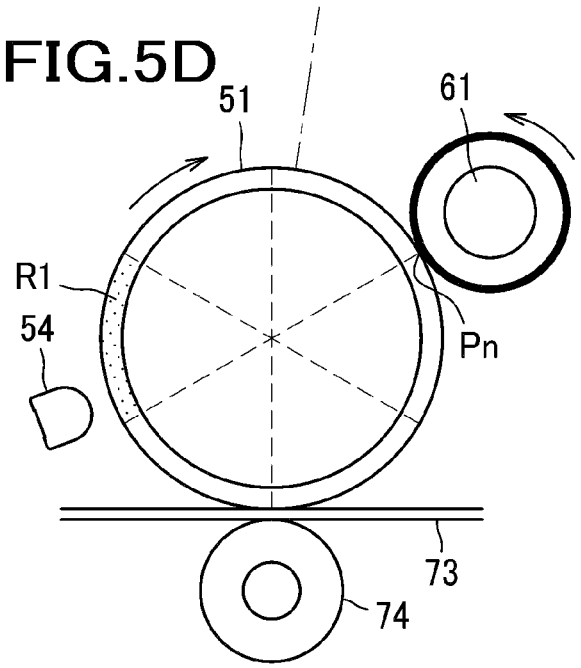

The second condition is set for the purpose of preventing poor formation of an electrostatic latent image which would be caused by the effect of preceding exposure remaining at a specific spot of the photoconductor drum 51 to be subsequently exposed to light after the photoconductor drum 51 subjected to the preceding exposure of the specific spot to light makes one full rotation. This phenomenon will now be discussed below with reference to FIGS. 5A and 5D. As shown in FIG. 5D, the first predetermined region R1 which has been exposed to light as in FIG. 5A for the development process is diselectrified when moving past the static eliminator lamp 54, but may possibly retain the residual effect of the preceding exposure. Subsequent (second) exposure of the first predetermined region R1 retaining the residual effect of the preceding exposure would result in poor formation of an electrostatic latent image. On this account, the pitch between the same color patches Gp should not be Lp1 multiplied by 5.

For the second image group G2, the order of the pattern images is determined so as to fulfil the conditions which include, in addition to the aforementioned first and second conditions:

3. a distance from a trailing edge of a second bias-corrective test image (e.g., K2) of a specific color (e.g., black) to a frontmost pattern image (e.g., Kγ1) of the same color should be equal to or longer than a predetermined distance La as represented by the equation below:

$$La=Lb+Lc$$

where Lb is a distance the patch Gp moves from the development nip position Pn to a detection position Pr at which detection by the detector PS occurs (see FIGS. 6A, 6B and 6C), Lc is a distance the patch Gp moves for a period of time elapsing since the second bias-corrective test image is detected until the developing bias is switched to a developing bias set in the bias setting process.

The distance Lb varies with the color. To be more specific, a distance LbK for the black color (see FIG. 6A) is shortest, and a distance LbC for the cyan color is second shortest. A distance LbM for the magenta color is third shortest, and a distance LbY for the yellow color is longest.

The distance Lc does not vary with the color. It is however to be understood that the distance Lc may vary with the color to some extent.

As is evident from the foregoing, a predetermined distance LaK for the black color is shortest, a predetermined distance LaC for the cyan color is second shortest, a predetermined distance LaM for the magenta color is third shortest, and a predetermined distance LaY for the yellow color is longest.

As shown in FIG. 4, the first bias-corrective test image K1 is located in a frontmost position in the direction of movement so that pattern images Kγ1, Kγ2, Kγ3, Kγ4 and Kγ5 of black corresponding to the shortest predetermined distance LaK can be formed earlier than the other images of colors other than the black color, and the second bias-corrective test image K2 is located in such a position that a spacing between the first bias-corrective test image K1 and the second bias-corrective test image K2 is the shortest, i.e., Lp1 multiplied by 2. In the following description, each image will be mentioned only by its reference character without its name, where appropriate.

Y1 is located immediately rearward of K1 and Y2 is located frontward of M2 and C2 so that formation of pattern images Yγ1, Yγ2, Yγ3, Yγ4 and Yγ5 for yellow corresponding to the longest predetermined distance LaY can be completed as early as possible. It is conceivable that the order of C1 and Y2 may be reversed and a spacing between Y1 and Y2 may be set at the shortest pitch of Lp1 multiplied by 2; however, in this setting, a blank region (empty region with no image formed) will be left between M2 and C2 because the spacing between C1 and C2 is Lp1 multiplied by 2, with the result that the length of the first image group G1 in the direction of movement would become disadvantageously longer. Therefore, the arrangement as shown in FIG. 4 may be preferable.

Y2, M2 and C2 are arranged from the frontmost image rearward in this order that is the decreasing order of the predetermined distance La. Accordingly, the number of blank regions can be minimized.

A distance from a trailing edge of K2 to a leading edge of Kγ1 is equal to or longer than the predetermined distance LaK.

A distance from a trailing edge of Y2 to a leading edge of Yγ1 is equal to or longer than the predetermined distance LaY.

A distance from a trailing edge of M2 to a leading edge of Mγ1 is equal to or longer than the predetermined distance LaM.

A distance from a trailing edge of C2 to a leading edge of Cγ1 is equal to or longer than the predetermined distance LaC.

In this example, the difference between a distance from the trailing edge of the second bias-corrective test image (e.g., K2) of a specific color (e.g., black) to the leading edge of the frontmost pattern image of the same color (e.g., Kγ1) and the predetermined distance for the same color (e.g., LaK) may be smaller for K or Y than for M or C. Accordingly, the entire length from the leading edge of the first image group G1 to the trailing edge of the second image group G2 formed on the conveyor belt 73 can be shortened.

The order of the images are determined as described above, and thus the controller 100 causes the bias-corrective test image forming process to start in the order of K, Y, M and C, and to end in the order of K, Y, M and C. Similarly, the controller 100 causes the bias setting process to start in the order of K, Y, M and C, and to end in the order of K, Y, M and C. Further, the controller 100 causes the pattern image forming process to start in the order of K, C, M and Y, and to end in the order of K, M, C and Y.

Next, a method of forming a first image group G1 by the controller 100 will be described. A method of forming a second image group G2 is similar to the method of forming a first image group G1; thus, a duplicate description will be omitted.

In the bias-corrective test image forming process, at the outset, the controller 100 causes the respective photoconductor drums 51 to be exposed to light in accordance with the order of exposure as stored in the memory or storage unit. Accordingly, as shown in FIG. 6A, Y1 is, in the first place, formed on the conveyor belt 73.

Figures 6A, 6B, 6C:
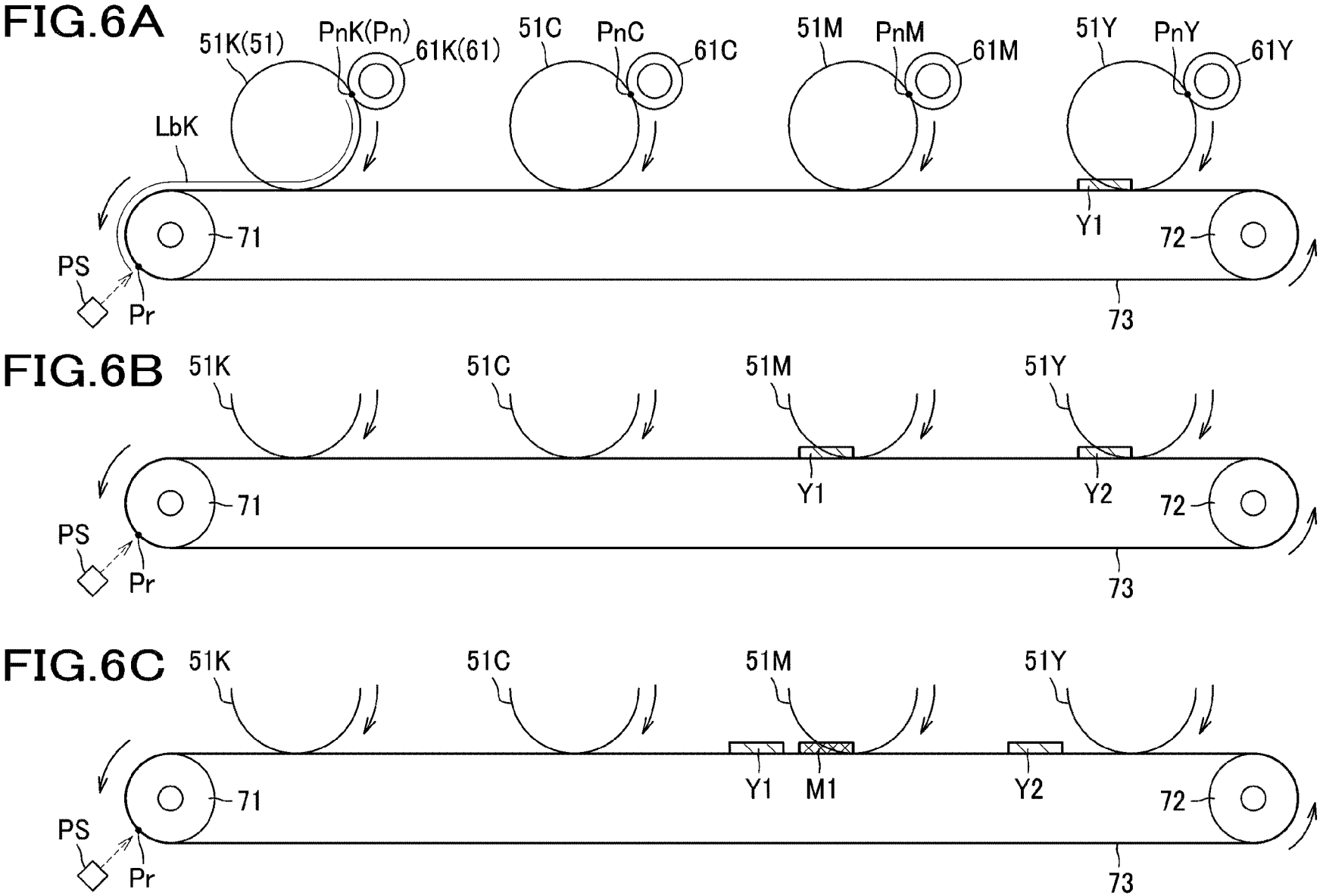
FIGS. 6A, 6B and 6C are schematic diagrams for explaining the order of first bias-corrective test images and second bias-corrective test images transferred onto a conveyor belt in a first half of the development process.

Subsequently, as shown in FIG. 6B, Y2 is formed in a position apart rearward from Y1 with a spacing of Lp1 multiplied by 3. Then, as shown in FIG. 6C, M1 is formed in a position apart rearward from Y1 with a spacing equivalent to the first pitch Lp1.

Figures 7A, 7B, 7C:
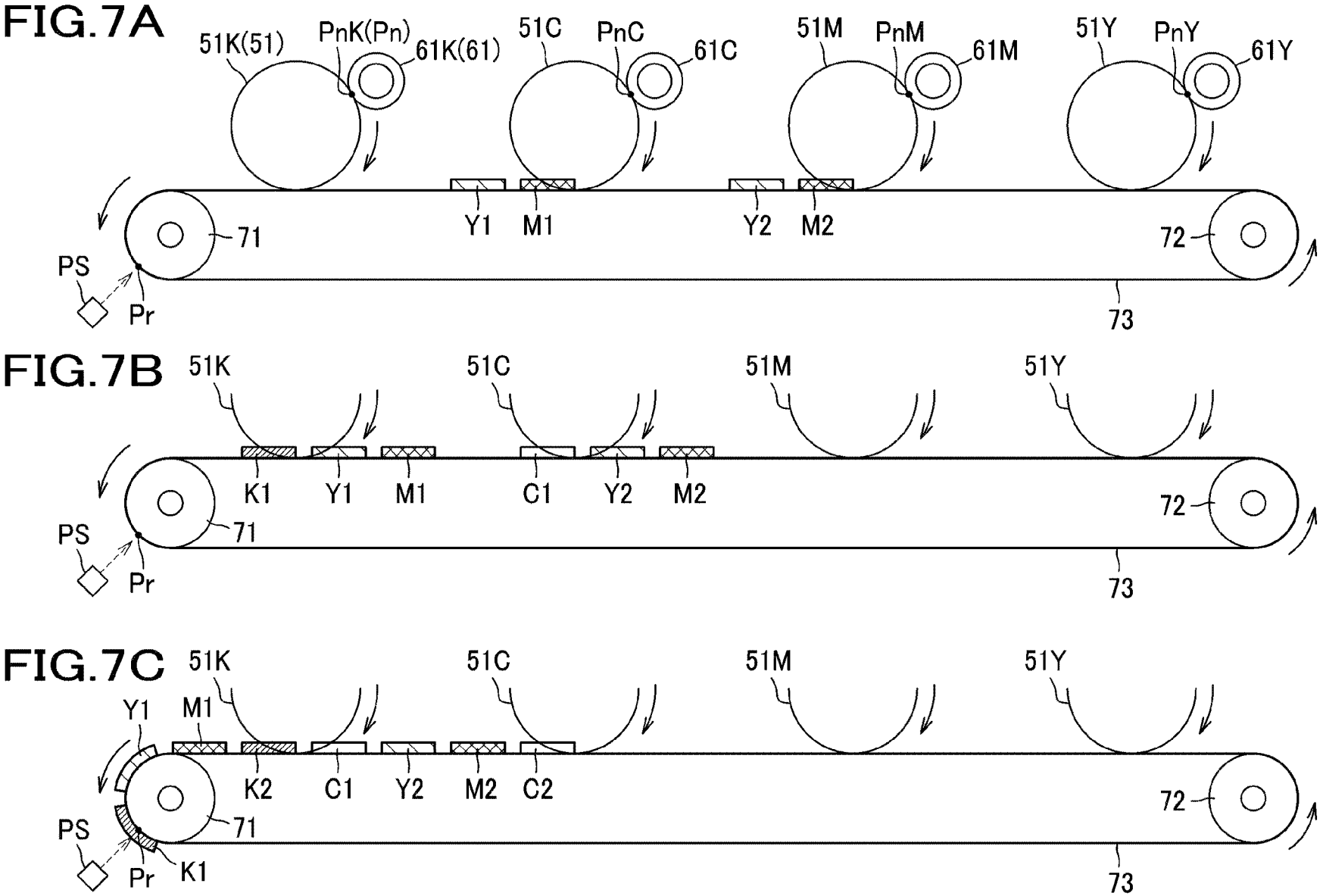
FIGS. 7A, 7B and 7C are schematic diagrams for explaining the order of first bias-corrective test images and second bias-corrective test images transferred onto the conveyor belt in a second half of the development process.

Thereafter, as shown in FIG. 7A, M2 is formed in a position apart rearward from Y2 with a spacing equivalent to the first pitch Lp1. Then, as shown in FIG. 7B, K1 is formed in a position apart frontward from Y1 with a spacing equivalent to the first pitch Lp1, and C1 is formed in a position apart frontward from Y2 with a spacing equivalent to the first pitch Lp1. Thereafter, as shown in FIG. 7C, K2 is formed in a position apart rearward from M1 with a spacing equivalent to the first pitch Lp1, and C2 is formed in a position apart rearward from M2 with a spacing equivalent to the first pitch Lp1.

In the present embodiment as described above, the following advantageous effects can be achieved.

The bias setting process for black can be ended earlier, and thus the pattern image forming process for black can be started earlier; consequently, the period of time elapsed from the start of the first bias-corrective test image forming process to the end of the last pattern image forming process for all the colors can be shortened.

Since the second bias-corrective test image K2 of black is located frontward of the first bias-corrective test image C1 for cyan in the direction of movement, the bias setting process for black can be completed earlier. Consequently, the period of time elapsed from the start of the first bias-corrective test image forming process to the end of the last pattern image forming process for all the colors can be further shortened.

Since the second bias-corrective test image Y2 for yellow is located frontward of the second bias-corrective test images M2, C2 for magenta and cyan in the direction of movement, the bias setting process for yellow can be completed earlier. Consequently, the period of time elapsed from the start of the first bias-corrective test image forming process to the end of the last pattern image forming process for all the colors can be shortened.

Since a distance from the leading edge of the frontmost first bias-corrective test image K1 to the trailing edge of the rearmost pattern image Yγ5 is shorter than the circumferential length of the conveyor belt 73, the need for executing a belt cleaning process of causing the conveyor belt 73 to make one-full or further rotation after the bias setting process before the pattern image forming process can be obviated. Consequently, the period of time elapsed from the start of the first bias-corrective test image forming process to the end of the last pattern image forming process for all the colors can be shortened. In the typical belt cleaning process, the conveyor belt 73 is caused to make two full rotations; therefore, the substantial effect of reduction of time can be expected by omission of the belt cleaning process in this embodiment.

The above-described embodiment may be modified and implemented in various forms as will be described below. In the following description, the same elements having similar structural features as those explained in connection with the above-described embodiment will be designated by the same reference characters, and a duplicated description thereof will be omitted.

Figure 8:
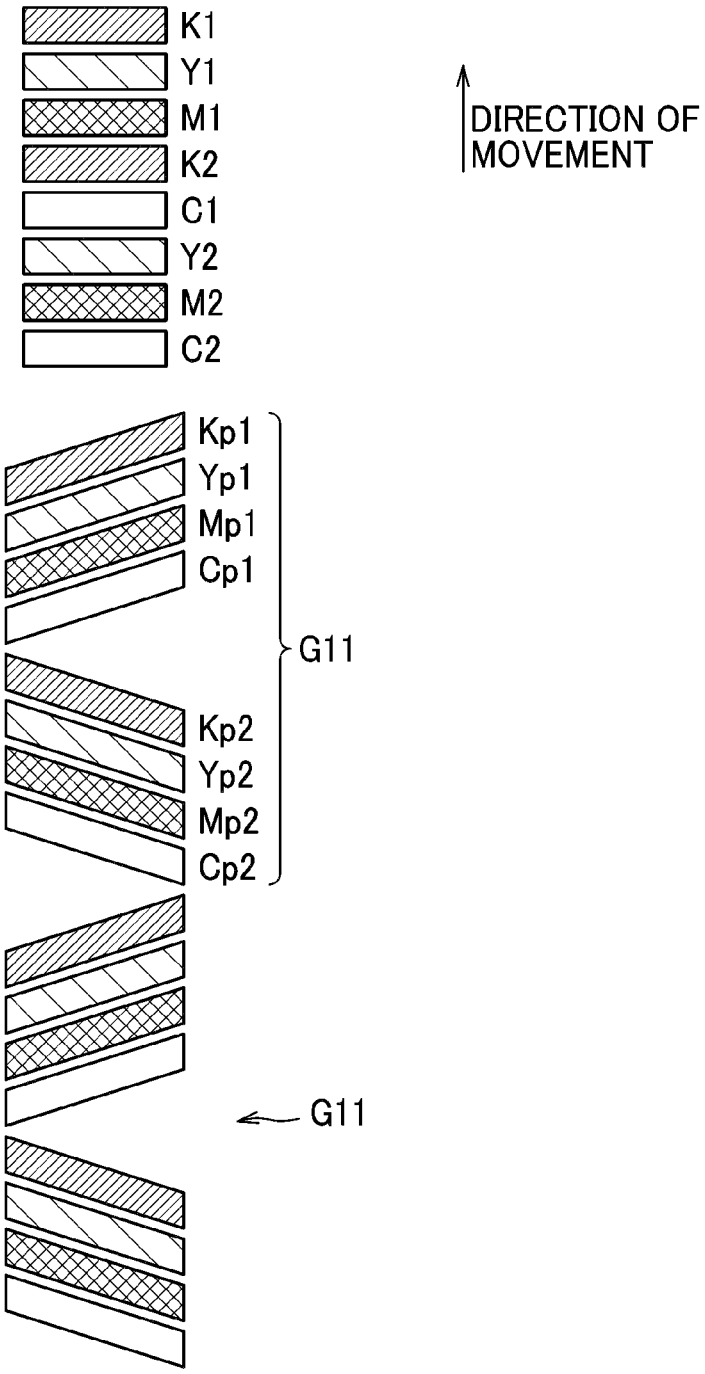
FIG. 8 is a diagram showing a modified example of print pattern images.

The pattern images may not be images to be used for setting a tone in the tone setting process as described above. For example, as shown in FIG. 8, the pattern image may be displacement-corrective test images Kp1, Yp1, Mp1, Cp1, Kp2, Yp2, Mp2 and Cp2 to be used for correcting displacements of images. To be more specific, the first displacement-corrective test images Kp1, Yp1, Mp1 and Cp1 extend in a predetermined direction. Herein, the predetermined direction may be an oblique direction or a parallel direction with respect to an across-the-width direction of the conveyor belt 73.

The second displacement-corrective test images Kp2, Yp2, Mp2 and Cp2 extend in oblique directions with respect to the predetermined direction. Image groups G11 each consisting of the displacement-corrective test images Kp1, Yp1, Mp1, Cp1, Kp2, Yp2, Mp2 and Cp2 are arranged in a direction opposite to the direction of movement. In this embodiment as well, the period of time elapsed from the start of the first bias-corrective test image forming process to the end of the last pattern image forming process for all the colors can be shortened.

The order of the images is not limited to that described above. The second bias-corrective test image of a first color may preferably be arranged in a position between two first bias-corrective test images selected among other three first bias-corrective test images of the second, third, and fourth colors. For example, in the above-described embodiment, K2 may be arranged in a position between Y1 and M1.

The order of the images may preferably be such that the color of a frontmost first bias-corrective test image that is located frontmost among a first set of images (in the first image group G1, consisting of the first bias-corrective test images of respective colors and the second bias corrective test images of the respective colors), and the color of a frontmost pattern image that is located frontmost among a second set of images (in the second image group G2, consisting of the pattern images of the respective colors) are the first color, and the color of a rearmost second bias-corrective test image that is located rearmost among the first set of images (in the first image group G1) and a color of a rearmost pattern image that is located rearmost among the second set of images (in the second image group G2) are different from each other. For example, in the above-described embodiment, the colors of the rearmost second bias-corrective test image that is located rearmost in the first image group G1 and of the rearmost pattern image that is located rearmost in the second image group G2 may be magenta and yellow, respectively.

The order of the images may preferably be such that the second bias-corrective test image of the first color is arranged in a position frontward (downstream) of one of other three first bias-corrective test images of the second, third, and fourth colors in the direction of movement. For example, in the above-described embodiment, K2 may be arranged frontward of M2.

The second bias-corrective test image of the fourth color may preferably be arranged in a position frontward (downstream) of at least one of second bias-corrective test images of the second and third colors in the direction of movement. For example, in the above-described embodiment, Y2 may be arranged between M2 and C2.

The first bias-corrective test image of the fourth color may preferably be arranged in a position frontward (downstream) of at least one of first bias-corrective test images of the second and third colors in the direction of movement. For example, in the above-described embodiment, Y1 may be arranged between M1 and K2.

A first developing bias for a predetermined color and a first developing bias for a color different from the predetermined color may be equal to or different from each other. A second developing bias for the predetermined color and a second developing bias for a color different from the predetermined color may be equal to or different from each other.

Besides the first bias-corrective test image and the second bias-corrective test image, a third bias-corrective test image may be formed between the first bias-corrective test image and the second bias-corrective test image, so that these three bias-corrective test images are used to correct the developing bias.

The following discussion will focus on another aspect of this disclosure relating a patch forming method that is a method for forming a patch of toner on a belt as a transfer medium, and an image forming apparatus in which the patch forming method is implemented.

The patch forming method disclosed herein is a method for forming a patch, as implemented in an image forming apparatus which comprises an image forming unit, a detector, and a controller. The image forming unit comprises a belt as a transfer medium. The image forming unit is configured to form a patch (test image) of toner of a predetermined color on the belt. The image forming unit further comprises a photoconductor drum for the predetermined color, a development roller for the predetermined color. The detector is configured to detect the patch formed on the belt. The patch forming method is executed by the controller.

The patch forming method comprises: forming a preceding patch of a predetermined color on the belt; and thereafter forming a succeeding patch of the predetermined color on the belt in a position distanced, upstream in the direction of movement of the belt, from the preceding patch, in such a manner that the succeeding patch consists of a first part and a second part, the first part extending over a first region defined between a first position apart upstream from a leading edge of the preceding patch at a distance equal to a drum circumferential length that is a circumferential length of the photoconductor drum and a second position apart upstream from a trailing edge of the preceding patch at the distance equal to the drum circumferential length, and a leading edge or a trailing edge of the succeeding patch is located in the first region, while the second part is located outside the first region, wherein the first part of the succeeding patch which extends over the first region has a length (overlap length Lo) in the direction of movement of the belt, the overlap length Lo being equal to or shorter than 3 millimeters.

Alternatively, the patch forming method comprises: forming a preceding patch of a predetermined color on the belt; and thereafter forming a succeeding patch of the predetermined color on the belt in a position distanced, upstream in the direction of movement of the belt, from the preceding patch, in such a manner that the succeeding patch consists of a first part and a second part, the first part extending over a second region defined between a third position apart upstream from a leading edge of the preceding patch at a distance equal to a roller circumferential length that is a circumferential length of the development roller and a fourth position apart upstream from a trailing edge of the preceding patch at the distance equal to the roller circumferential length, and a leading edge or a trailing edge of the succeeding patch is located in the first region, while the second part is located outside the second region, wherein the first part of the succeeding patch which extends over the second region has a length (overlap length Lo) in the direction of movement of the belt, the overlap length Lo being equal to or shorter than 3 millimeters.

Figure 9:
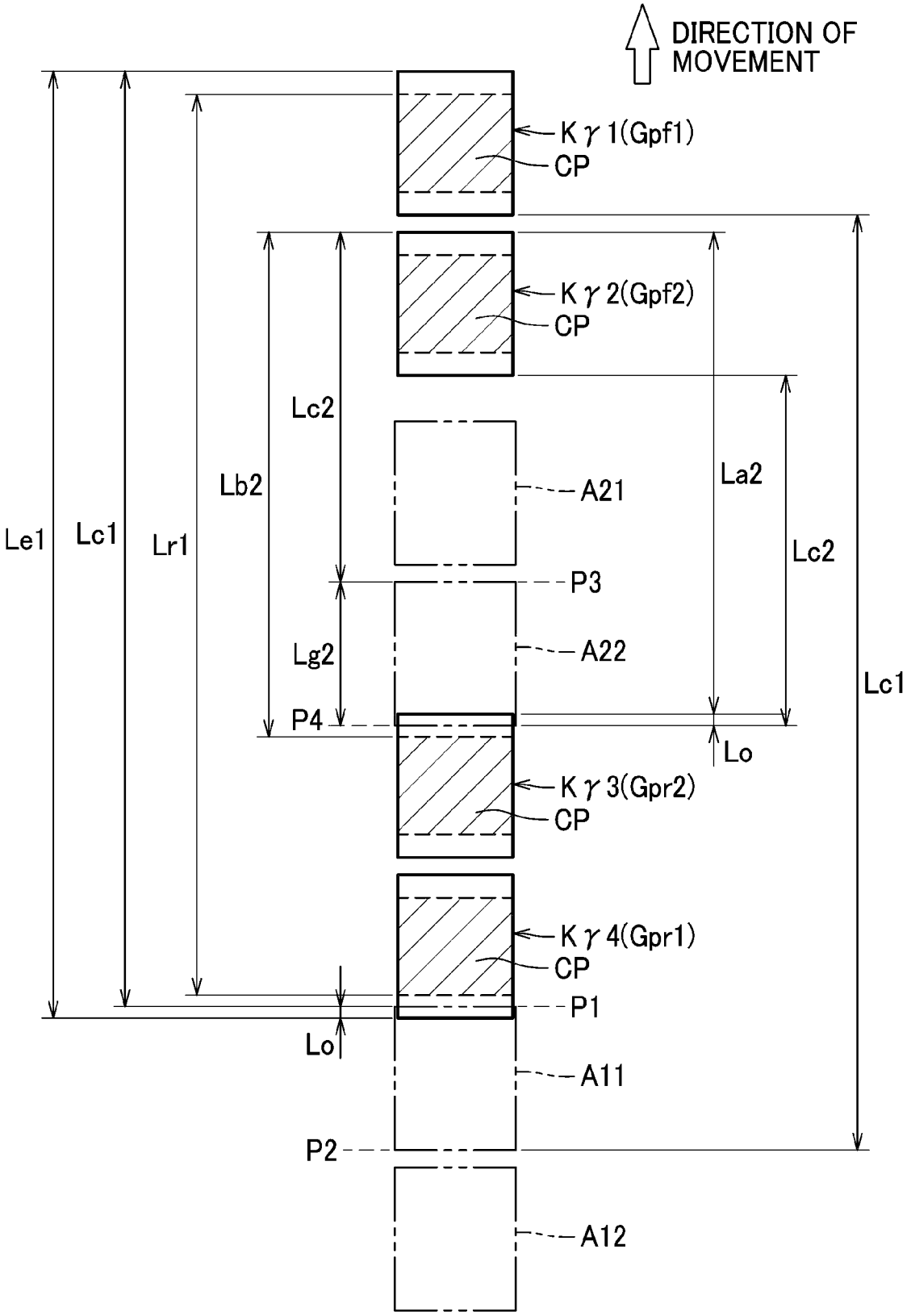
FIG. 9 is a diagram showing a relationship between preceding patches and succeeding patches.

To be more specific, referring now to FIG. 9, the controller 100 is configured to be capable of causing the image forming unit 4 to form a first preceding patch Gpf1 of black color on the conveyor belt 73 and thereafter form a first succeeding patch Gpr1 of the same black color on the conveyor belt 73 in a position distanced, upstream in the direction of movement, from the first preceding patch Gpf1. Herein, the first succeeding patch Gpr1 is a patch, part (first part) of which extends over a first region A11 as will be described below. In the example shown in FIG. 9, the first preceding patch Gpf1 is a pattern image Kγ1, and the first succeeding patch Gpr1 is a pattern image Kγ4.

When the controller 100 causes the image forming unit 4 to form the first succeeding patch Gpr1, part of the first succeeding patch Gpr1 extends over the first region A11 defined between a first position P1 apart upstream from a leading edge of the first preceding patch Gpf1 at a distance equal to a drum circumferential length Lc1 that is a circumferential length of the photoconductor drum 51 and a second position P2 apart upstream from a trailing edge of the first preceding patch Gpf1 at the distance equal to the drum circumferential length Lc1, and a trailing edge of the first succeeding patch Gpr1 is located in the first region A11. In other words, that part (first part) of the first succeeding patch Gpr1 which includes its trailing edge extends over the first region A11 and the other part (second part) of the first succeeding patch Gpr1 which does not include its trailing edge does not extend over the first region A11, i.e., it is located outside the first region A11. The overlap length Lo that is a length (in the direction of movement) of the part (which extends over the first region A11) of the first succeeding patch Gpr1 is equal to or shorter than 3 millimeters.

To be more specific, the lower limit of the overlap length Lo may be preferably 0.5 millimeters, and more preferably 1.0 millimeter. The upper limit of the overlap length Lo may be preferably 3.0 millimeters, and more preferably 2.5 millimeters. The lower limit and the upper limit may be chosen individually as appropriate to make a good combination.

For example, in the present embodiment, the entire length of the patch Gp in the direction of movement is 12 millimeters, the length of a middle area CP in the direction of movement is 7.0 millimeters, and each of the lengths of areas at the front (leading) edge and at the rear (trailing) edge where print densities are likely to become instable, in the direction of movement, is 2.5 millimeters; therefore, the overlap length Lo is preferably between or equal to 0.5 millimeters and 3.0 millimeters, and more preferably between or equal to 1.0 millimeter and 2.5 millimeters.

In this embodiment, specifically, the overlap length Lo of the area which extends over the first region A11 (length corresponding to the overlap of cycles of rotation of the photoconductor drum 51) is 1.3 millimeter.

The patch Gp has a middle area CP as indicated by oblique hatchings in FIG. 9. The middle area CP is an area apart from the leading edge and the trailing edge of the patch Gp at a distance equal to or longer than the overlap length Lo. The middle area CP is a part (of the patch Gp) to be detected by the detector PS to acquire information therefrom for use in processes executed by the controller 100. In the present embodiment, the controller 100 is configured to cause the detector PS to read the entire area from the leading edge to the trailing edge of the patch Gp, and execute the processes based on the results of detection acquired from the middle area CP, without using the results of detection acquired from the other areas (areas other than the middle area CP). It is to be understood that the controller 100 may alternatively be configured to cause the detector PS to read only the middle area CP of the patch Gp while not to read the areas other than the middle area CP.

The drum circumferential length Lc1, a distance Le1 from a leading edge of the first preceding patch Gpf1 to a trailing edge of the first succeeding patch Gpr1, and a distance Lr1 from a leading edge of the middle area CP of the first preceding patch Gpf1 to a trailing edge of the middle area CP of the first succeeding patch Gpr1 are set to satisfy the following conditions:

$$Lr1<Lc1<Le1.$$

The controller 100 is configured to be capable of causing the image forming unit 4 to form a second preceding patch Gpf2 of black color on the conveyor belt 73 and thereafter form a second succeeding patch Gpr2 of the same black color on the conveyor belt 73 in a position distanced, upstream in the direction of movement, from the second preceding patch Gpf2. Herein, the second succeeding patch Gpr2 is a patch, part of which extends over a second region A22 as will be described below. In the example shown in FIG. 9, the second preceding patch Gpf2 is a pattern image Kγ2, and the second succeeding patch Gpr2 is a pattern image Kγ3.

When the controller 100 causes the image forming unit 4 to form the second succeeding patch Gpr2, part of the second succeeding patch Gpr2 extends over the second region A22 defined between a third position P3 apart upstream from a leading edge of the second preceding patch Gpf2 at a distance equal to a roller circumferential length Lc2 that is a circumferential length of the development roller 61 and a fourth position P4 apart upstream from a trailing edge of the second preceding patch Gpf2 at the distance equal to the roller circumferential length Lc2, and a leading edge of the second succeeding patch Gpr2 is located in the second region A22. In other words, that part (first part) of the second succeeding patch Gpr2 which includes its leading edge extends over the second region A22 and the other part (second part) of the second succeeding patch Gpr2 which does not include its leading edge does not extend over the second region A22, i.e., it is located outside the second region A22. The overlap length Lo that is a length (in the direction of movement) of the part (which extends over the second region A22) of the second succeeding patch Gpr2 is equal to or shorter than 3 millimeters.

To be more specific, the lower limit of the overlap length Lo may be preferably 0.5 millimeters, and more preferably 1.0 millimeter. The upper limit of the overlap length Lo may be preferably 3.0 millimeters, and more preferably 2.5 millimeters. The lower limit and the upper limit may be chosen individually as appropriate to make a good combination.

For example, in the present embodiment, the entire length of the patch Gp in the direction of movement is 12 millimeters, the length of a middle area CP in the direction of movement is 7.0 millimeters, and each of the lengths of areas at the front (leading) edge and at the rear (trailing) edge where print densities are likely to become instable, in the direction of movement is 2.5 millimeters; therefore, the overlap length Lo is preferably between or equal to 0.5 millimeters and 3.0 millimeters, and more preferably between or equal to 1.0 millimeter and 2.5 millimeters.

In this embodiment, specifically, the overlap length Lo of the area which extends over the second region A22 is 2.4 millimeters.

The roller circumferential length Lc2, a distance La2 from a leading edge of the second preceding patch GPf2 to a leading edge of the second succeeding patch Gpr2, a length Lg2 of the patch Gp in the direction of movement, and a distance Lb2 from the leading edge of the second preceding patch GPf2 to a leading edge of the middle area CP of the second succeeding patch Gpr2 are set to satisfy the following conditions:

$$Lb2>Lc2+Lg2>La2.$$

The first region A11 mentioned above is a region corresponding to a region of or an area on the photoconductor drum 51 where the first preceding patch Gpf1 had been formed. The second region A22 mentioned above is a region corresponding to a region of or an area on the development roller 61 where toner for forming the second preceding patch Gpf2 had been carried. The first region A11 or the second region A22 may retain the residual effect of the preceding patch Gp forming process (hereinafter referred to also as "influence of memory effect"); therefore, formation of patches Gp within the first region A11 or the second region A22 would disadvantageously make the print densities of the patch Gp instable. This phenomenon will now be described with reference to FIGS. 5A, 5B, 5C and 5D.

As shown in FIGS. 5A and 5B, when a first predetermined region R1 of a photosensitive surface of the photoconductor drum 51 is exposed to light, toner carried in a second predetermined region R2 of the development roller 61 is transferred to the first predetermined region R1, whereby a patch Gp is formed on the first predetermined region R1 of the photoconductor drum 51. As shown in FIG. 5C, if the development roller 61 rotates a half-turn from the position shown in FIG. 5B and the second predetermined region R2 reaches a development nip position Pn (an interface between the photoconductor drum 51 and the development roller 61) again, the amount of toner on the second predetermined region R2 would possibly be smaller than that of toner carried and transferred when the patch Gp was formed in the first predetermined region R1 of the photoconductor drum 51. The patch Gp formed by transferring toner on the second predetermined region R2 to the photoconductor drum 51 in this situation would disadvantageously become unstable in density. Supposing the toner on the second predetermined region R2 is transferred to the photoconductor drum 51 and forms a patch Gp, the patch Gp transferred onto the conveyor belt 73 is formed in an entire area defined by the second region A22 shown in FIG. 9.

In this embodiment, the leading edge of the second succeeding patch Gpr2 is located in the second region A22. The area at the leading edge of the second succeeding patch Gpr2 includes such an area susceptible to the influence of edge effect or the influence of difference in peripheral velocity between the photoconductor drum 51 and the development roller 61, as would likely make the densities instable, and thus is not used for the control processes executed by the controller 100. Accordingly, the area at the leading edge of the second succeeding patch Gpr2 which extends over the second region A22 would not affect the control processes.

As shown in FIG. 5D, the first predetermined region R1 which is a light-exposed region of the photoconductor drum 51 is diselectrified when moving past the static eliminator lamp 54, but would possibly retain the residual effect of the preceding exposure. If the first predetermined region R1 retaining the residual effect of the preceding exposure is exposed to light again, an electrostatic latent image formed thereby would be defective; accordingly, the patch Gp formed in the first predetermined region R1 would disadvantageously become unstable in density. Supposing the patch Gp formed in the first predetermined region R1 retaining the residual effect of the preceding exposure is transferred to the conveyor belt 73, the patch Gp is formed in an entire area defined by the second region A11 as shown in FIG. 9.

In this embodiment, the trailing edge of the first succeeding patch Gpr1 is located in the first region A11. The area at the trailing edge of the first succeeding patch Gpr1 includes such an area susceptible to the influence of edge effect or the influence of difference in peripheral velocity between the photoconductor drum 51 and the development roller 61, as would likely make the densities instable, and thus is not used for the control processes executed by the controller 100. Accordingly, the area at the trailing edge of the first succeeding patch Gpr1 extending over the first region A11 would be subject to instability in density, but not affect the control processes.

As shown in FIG. 9, patches Gp other than the first and second preceding patches Gpf1, Gpf2 and the first and second succeeding patches Gpr1, Gpr2 are formed in such positions as not to extend over the first region A11, a first region A12, the second region A21, and a second region A22. Herein, the first region A12 is a region corresponding to a region of or an area on the photoconductor drum 51 where the patch Gp of Kγ2 had been formed. The second region A21 is a region corresponding to a region of or an area on the development roller 61 where toner for forming the patch Gp of Kγ1 had been carried.

As shown in FIG. 4, each of the patches Gp of the first image group G1 is different from each of the patches Gp of the second image group G2 in patch length (length of the patch Gp in the direction of movement); therefore, in the first image group G1, there is no such patch as meeting the relationship between the preceding patches and the succeeding patches.

In contrast, among the patches Gp of the second image group G2, besides the patch Gp of black color shown in FIG. 9 and described above, there are patches Gp which meet the relationship between the preceding patches and the succeeding patches.

For example, such patches Gp of black color include, other than those shown in FIG. 9, Kγ4 corresponding to the second preceding patch Gpf2, and Kγ5 corresponding to the second succeeding patch Gpr2.

Similarly, such patches Gp of cyan color include Cγ1 corresponding to the first preceding patch Gpf1, and Cγ3 corresponding to the first succeeding patch Gpr1.

Such patches Gp of magenta color include Mγ1 corresponding to Gpf1, and Mγ3 corresponding to Gpr1. Mγ3 corresponds to Gpf2, and Mγ4 corresponds to Gpr2.

Such patches Gp of yellow color include Yγ3 corresponding to Gpf1, and Yγ5 corresponding to Gpr1. Yγ2 corresponds to Gpf2, and Yγ3 corresponding to Gpr2.

In the present embodiment as described above, the following advantageous effects can be achieved.

Since part of the first succeeding patch Gpr1 is positioned to extend over the first region A11 which may retain residual effects resulting from formation of the first preceding patch Gpf1, the degree of flexibility in arrangement of the patches Gp can be increased. Moreover, the overlap length Lo limited to 3 millimeters or shorter makes it possible to increase the length of the edge-effect-free middle area CP of the patch Gp located outside the first region A11 in the direction of movement while allowing the area at the edge of the patch Gp liable to possible instability in density due to edge effect to extend over the first region A11; therefore, the number of detectable dots in the middle area CP can be increased.

Since part of the first succeeding patch Gpr1 including its trailing (rear) edge is positioned to extend over the first region A11 (i.e., the first succeeding patch Gpr1, at its trailing edge, overlaps the first region A11), the distance between the first preceding patch Gpf1 and the first succeeding patch Gpr1 can be reduced, so that the time required to form a plurality of patches Gp can be shortened.

Since part of the second succeeding patch Gpr2 is positioned to extend over the second region A22 which may retain residual effects resulting from formation of the second preceding patch Gpf2, the degree of flexibility in arrangement of the patches Gp can be increased. Moreover, the overlap length Lo limited to 3 millimeters or shorter makes it possible to increase the length of the edge-effect-free middle area CP of the patch Gp located outside the second region A22 in the direction of movement while allowing the area at the edge of the patch Gp liable to possible instability in density due to edge effect to extend over the second region A22; therefore, the number of detectable dots in the middle area CP can be increased.

Since the controller 100 executes the tone setting process based on outputs of the detector PS as generated upon detection of a plurality of patches including the preceding patches Gpf1, Gpf2, and the succeeding patches Gpr1, Gpr2, the densities of areas of the patches Gp suffering from no edge effect or memory effect can be utilized in the tone setting process and the tone setting process can thus be executed precisely.

The above-described embodiment may be modified and implemented in various forms as will be described below. In the following description, the same elements or patches having similar structural features as those explained in connection with the above-described embodiment will be designated by the same reference characters, and a duplicate description thereof will be omitted.

Figure 10:
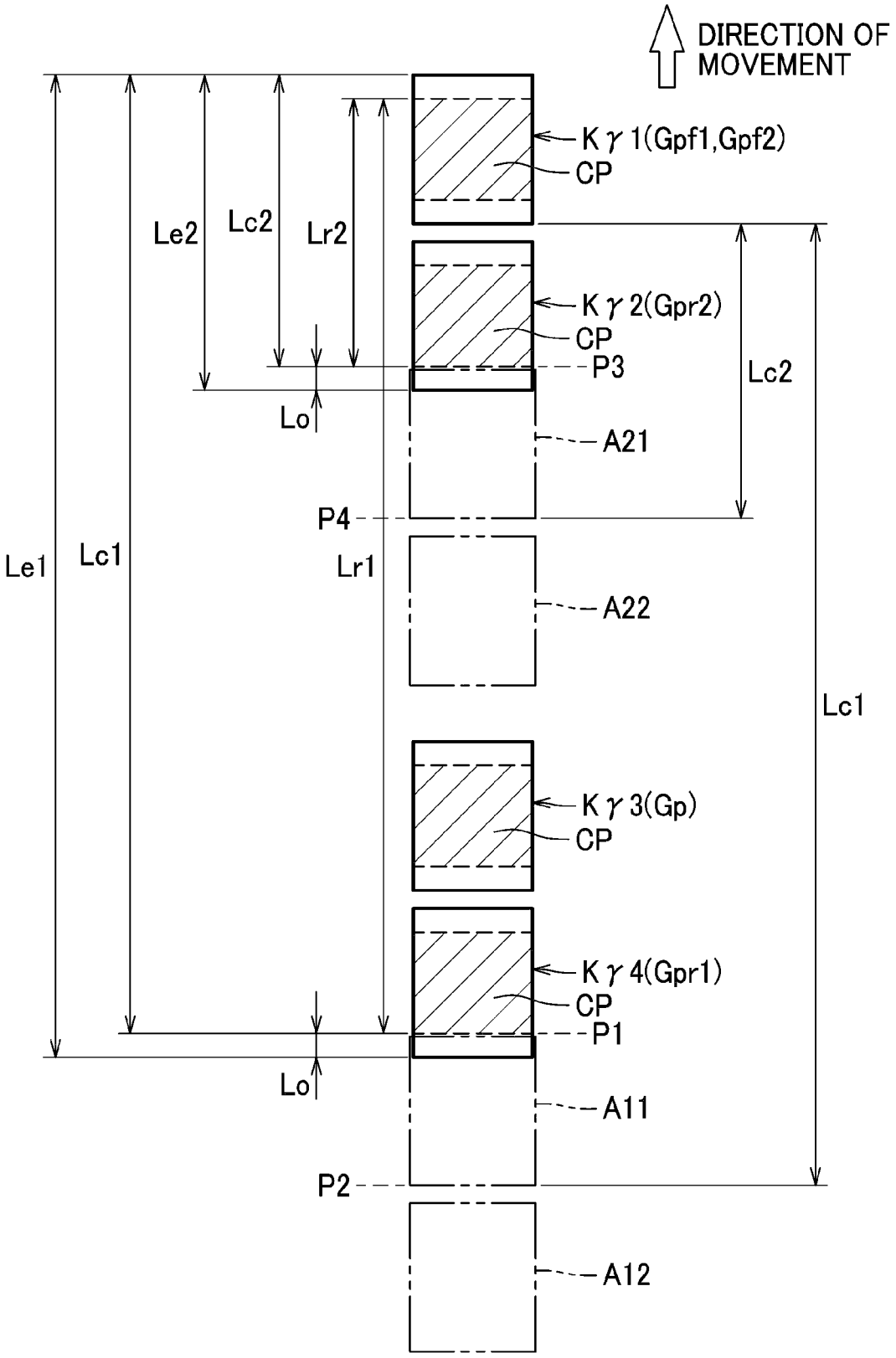
FIG. 10 is a diagram showing a first modified example of the relationship between preceding patches and succeeding patches.

The way of overlapping arrangement of the preceding patches and the succeeding patches is not limited to that described above. For example, as shown in FIG. 10, part of the second succeeding patch Gpr2 including its trailing edge may be positioned to extend over the second region A21. In this alternative, the roller circumferential length Lc2 is shorter than that as in the aforementioned embodiment. Herein, the second preceding patch Gpf2 is a pattern image Kγ1. The second region A21 is defined between a third position P3 apart upstream from a leading edge of the pattern image Kγ1 at a distance equal to the roller circumferential length Lc2 and a fourth position P4 apart upstream from a trailing edge of the pattern image Kγ1 at the distance equal to the roller circumferential length Lc2. The second succeeding patch Gpr2 is the pattern image Kγ2, of which part including its trailing edge extends over the second region A21.

The roller circumferential length Lc2, a distance Le2 from a leading edge of the second preceding patch Gpf2 to a trailing edge of the second succeeding patch Gpr2, and a distance Lr2 from a leading edge of the middle area CP of the second preceding patch Gpf2 to a trailing edge of the middle area CP of the second succeeding patch Gpr2 are set to satisfy the following conditions:

$$Lr2<Lc2<Le2.$$

In this embodiment, part of the second succeeding patch Gpr2 including its trailing (rear) edge is positioned to extend over the second region A21 (i.e., the second succeeding patch Gpr2, at its trailing edge, overlaps the second region A21); therefore, the distance between the second preceding patch Gpf2 and the second succeeding patch Gpr2 can be reduced, so that the time required to form a plurality of patches Gp can be shortened.

Figure 11:
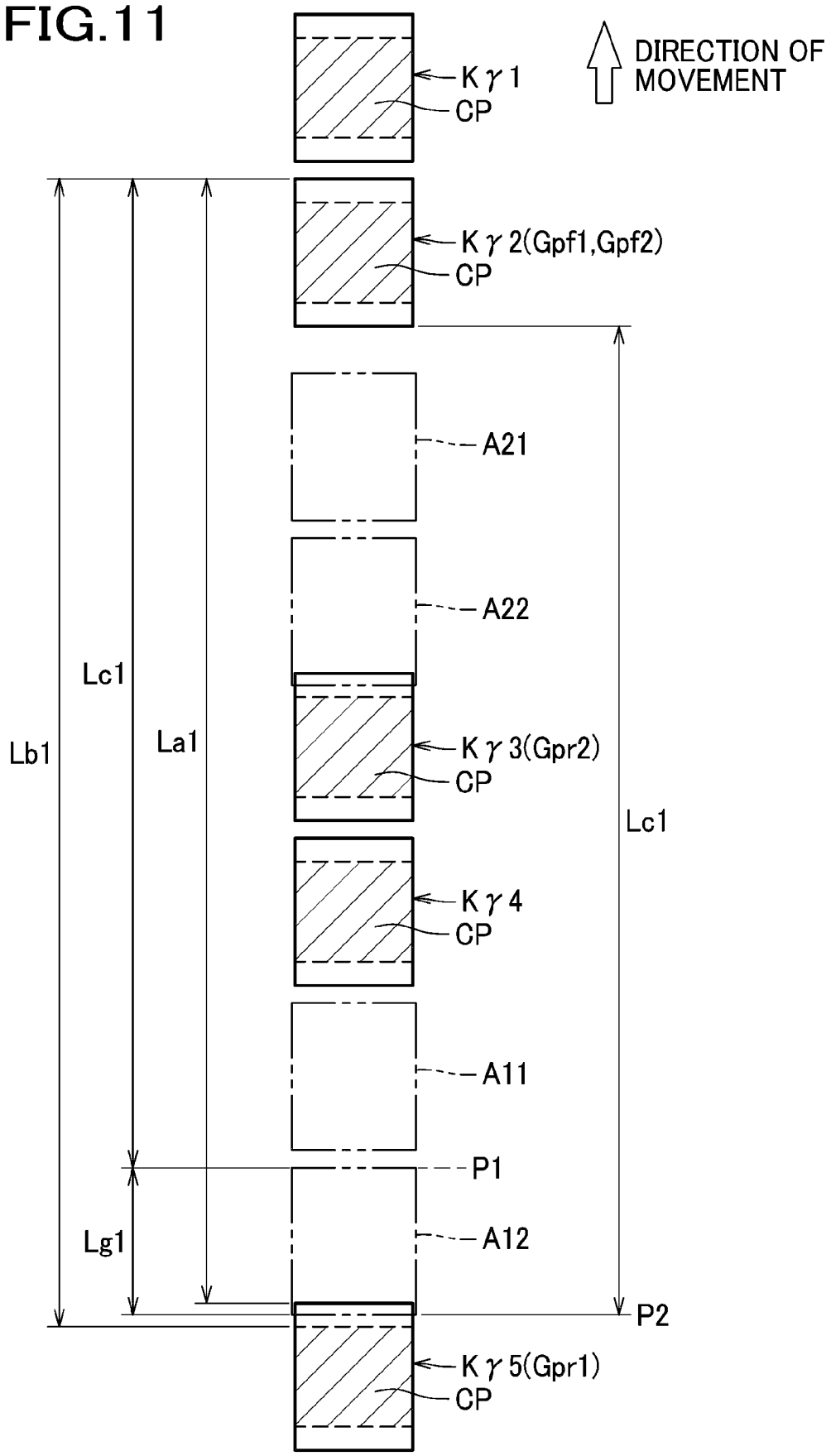
FIG. 11 is a diagram showing a second modified example of the relationship between preceding patches and succeeding patches.

As shown in FIG. 11, part of the first succeeding patch Gpr1 including its trailing edge may be positioned to extend over the first region A12. In this alternative, the drum circumferential length Lc1 is longer than that as in the aforementioned embodiment. Herein, the pitches between the patches Gp are not equal. The first preceding patch Gpf1 is a pattern image Kγ2. The first region A12 is defined between a first position P1 apart upstream from a leading edge of the pattern image Kγ2 at a distance equal to the drum circumferential length Lc1 and a second position P2 apart upstream from a trailing edge of the pattern image Kγ2 at the distance equal to the drum circumferential length Lc1. The first succeeding patch Gpr1 is the pattern image Kγ5, of which part including its leading edge extends over the first region A12.

The drum circumferential length Lc1, a distance La1 from a leading edge of the first preceding patch Gpf1 to a leading edge of the first succeeding patch Gpr1, a length Lg1 of the patch Gp in the direction of movement, and a distance Lb1 from the leading edge of the first preceding patch Gpf1 to a leading edge of the middle area CP of the first succeeding patch Gpr1 are set to satisfy the following conditions:

$$Lb1>Lc1+Lg1>La1.$$

The first image group G1, which includes no preceding patches Gpf1, Gpf2 or the succeeding patches Gpr1, Gpr2 in the above-described embodiment, may be provided to include the preceding patches Gpf1, Gpf2 and the succeeding patches Gpr1, Gpr2. In the following description of this alternative embodiment, it is assumed that the lengths of the bias-corrective test images in the direction of movement and the lengths of the pattern images in the direction of movement are all equal, and the first pitch Lp1 and the second pitch Lp2 are equal to each other.

Figure 12:
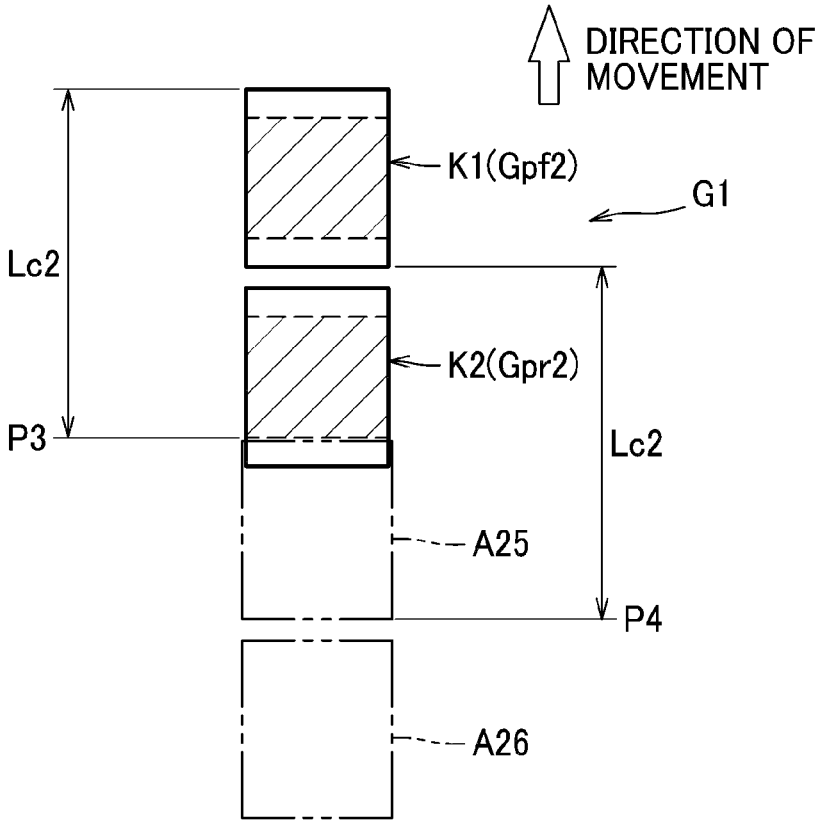
FIG. 12 is a diagram showing a third modified example of the relationship between preceding patches and succeeding patches.

Specifically, as shown in FIG. 12, the first bias-corrective test image K1 and the second bias-corrective test image K2 may be formed successively, so that K1 and K2 are arranged as the second preceding patch Gpf2 and the second succeeding patch Gpr2. In this example, a second region A25 is defined between a third position P3 apart upstream from a leading edge of the first bias-corrective test image K1 at a distance equal to the roller circumferential length Lc2 and a fourth position P4 apart upstream from a trailing edge of the first bias-corrective test image K1 at the distance equal to the roller circumferential length Lc2. Part of the second bias-corrective test image K2 including its trailing edge extends over the second region A25.

Figure 13:
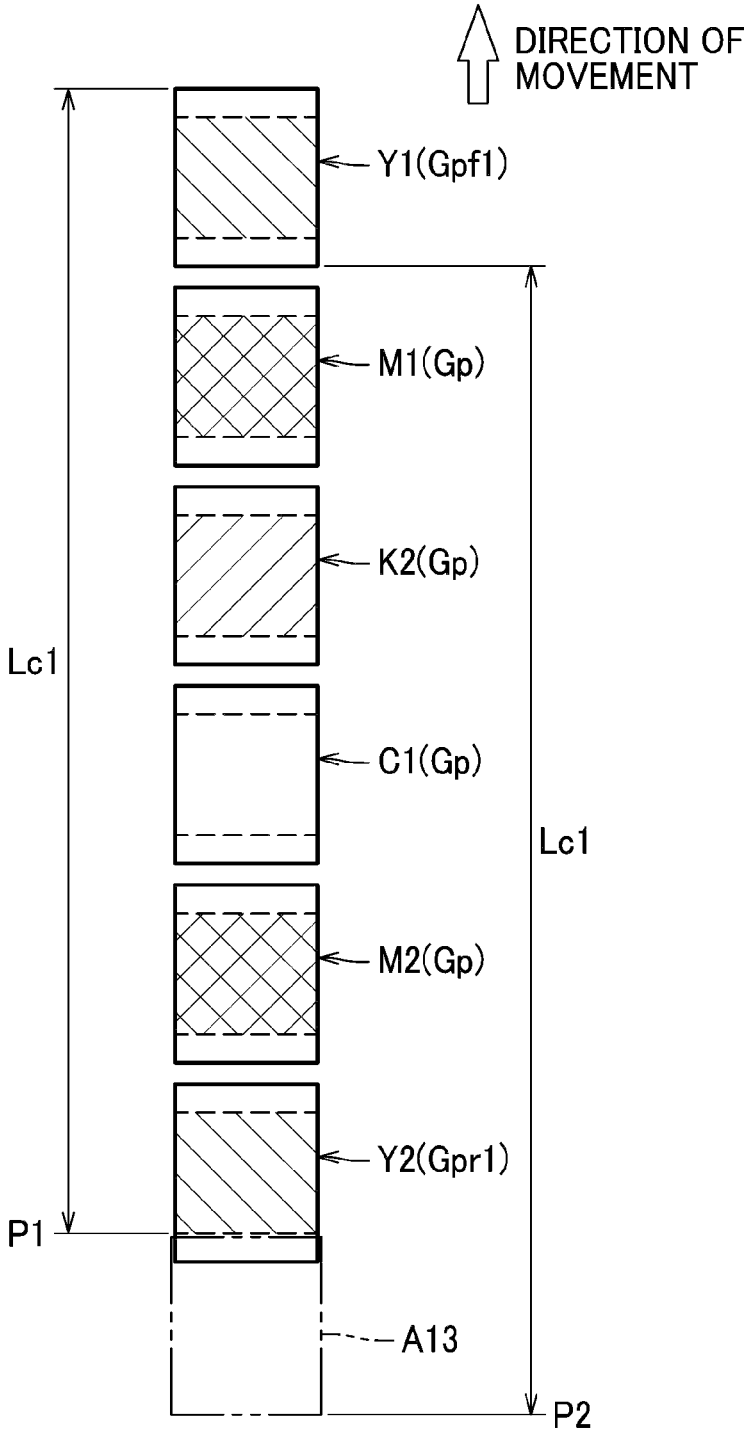
FIG. 13 is a diagram showing a fourth modified example of the relationship between preceding patches and succeeding patches.

As shown in FIG. 13, the bias-corrective test images may be arranged in the order, from the frontmost image on down, of Y1, M1, K2, C1, M2, and Y2 in a direction opposite to the direction of movement, so that Y1 is the first preceding patch Gpf1 and Y2 is the first succeeding patch Gpr1. In this example, a first region A13 may be defined between a first position P1 apart upstream from a leading edge of the first bias-corrective test image Y1 at a distance equal to the drum circumferential length Lc1 and a second position P2 apart upstream from a trailing edge of the first bias-corrective test image Y1 at the distance equal to the drum circumferential length Lc1. Part of the second bias-corrective test image Y2 including its trailing edge extends over the first region A13.

With the arrangements shown in FIG. 12 and FIG. 13, the controller 100 executes the bias setting process based on outputs of the detector PS as generated upon detection of a plurality of patches including the preceding patch Gpf1, Gpf2 and the succeeding patch Gpr1, Gpr2; therefore, the densities of areas of the patches Gp suffering from no edge effect or memory effect can be utilized in the bias setting process, and the bias setting process can thus be executed precisely.

In the above-described embodiment, the conveyor belt 73 is given as an example of a transfer medium; however, the belt may be an intermediate transfer belt, and the transfer medium may be a medium other than a belt, and may be a sheet, such as a sheet of paper, which is can be supplied from outside of the image forming apparatus.

In the above-described embodiment, the color printer 1 is taken as an example of an image forming apparatus; however, the image forming apparatus may be any other type of apparatus such as a copier, a multifunction peripheral, etc.

In the above-described embodiment, the color printer 1 is illustrated as including a laser scanner-type exposure device SC to expose photoconductor drums to light; however, the exposure device may be of any other types, such as an exposure device including LED exposure heads, etc.

The first photoconductor drum, the second conductor drum, the third photoconductor drum, and the fourth photoconductor drum may be supported by a single cartridge, or supported individually by respective cartridges.

The elements described in the above embodiment and its modified examples may be implemented selectively and in combination.

What is claimed is:

1. An image forming apparatus comprising:

an image forming unit configured to form a toner image on a transfer medium, the image forming unit comprising four sets of a photoconductor drum and a development roller, the four sets consisting of a first set for forming a toner image of a first color, a second set for forming a toner image of a second color, a third set for forming a toner image of a third color, and a fourth set for forming a toner image of a fourth color, a detector configured to detect a toner image formed on the transfer medium passing by the detector; and a controller, wherein the photoconductor drums for the first, second, third and fourth colors are arranged in this order, in a direction opposite to a direction of movement of the transfer medium moving toward the detector, wherein the controller is capable of executing, for each of the first color, the second color, the third color, and the fourth color:

a bias-corrective test image forming process of causing the image forming unit to form a first bias-corrective test image on the transfer medium with a first developing bias being applied to the development roller, and to form a second bias-corrective test image on the transfer medium with a second developing bias being applied to the development roller, the second developing bias having a value different from a value of the first developing bias; and a bias setting process of setting a developing bias based on outputs of the detector as generated upon detection of the first bias-corrective test image and the second bias-corrective test image, wherein the controller is configured to execute the bias-corrective test image forming process in such a manner that a first bias-corrective test image of the first color is arranged in a position downstream of other three first bias-corrective test images of the second, third, and fourth colors in the direction of movement of the transfer medium, and a second bias-corrective test image of the first color is arranged in a position between two first bias-corrective test images selected among other three first bias-corrective test images of the second, third, and fourth colors in the direction of movement of the transfer medium.

2. The image forming apparatus according to claim 1, wherein the controller is configured to execute the bias-corrective test image forming process in such a manner that a second bias-corrective test image of the fourth color is arranged in a position downstream of at least one of second bias-corrective test images of the second and third colors in the direction of movement of the transfer medium.

3. The image forming apparatus according to claim 1, wherein the controller is configured to execute the bias-corrective test image forming process in such a manner that a first bias-corrective test image of the fourth color is arranged in a position downstream of at least one of first bias-corrective test images of the second and third colors in the direction of movement of the transfer medium.

4. The image forming apparatus according to claim 1, wherein the controller is configured to execute the bias-corrective test image forming process in such a manner that a first bias-corrective test image of the first color, a first bias-corrective test image of the fourth color, a first bias-corrective test image of the third color, a second bias-corrective test image of the first color, and a first bias-corrective test image of the second color are arranged in this order in the direction opposite to the direction of movement of the transfer medium.

5. The image forming apparatus according to claim 4, wherein the controller is configured to execute the bias-corrective test image forming process in such a manner that second bias-corrective test images of the fourth, third, and second colors are located in positions downstream of a first bias-corrective test image of the second color in the direction of movement of the transfer medium and arranged in this order in the direction opposite to the direction of movement of the transfer medium.

6. The image forming apparatus according to claim 1, wherein the transfer medium is an endless belt, wherein the controller is further capable of executing a pattern image forming process of causing the image forming unit to form a plurality of pattern images on the transfer medium with the developing bias set in the bias setting process being applied to the development roller, for each of the first color, the second color, the third color, and the fourth color, and wherein a distance from a leading edge of a frontmost first bias-corrective test image that is located frontmost among the first bias-corrective test images to a trailing edge of a rearmost pattern image that is located rearmost among the pattern images is smaller than a circumferential length of the endless belt.

7. The image forming apparatus according to claim 1, wherein the controller is further capable of executing a pattern image forming process of causing the image forming unit to form a plurality of pattern images on the transfer medium with the developing bias set in the bias setting process being applied to the development roller, for each of the first color, the second color, the third color, and the fourth color, and wherein the pattern images are tone setting images to be used for setting a correlation between a target print density and an exposure pixel density.

8. The image forming apparatus according to claim 1, wherein the controller is further capable of executing a pattern image forming process of causing the image forming unit to form a plurality of pattern images on the transfer medium with the developing bias set in the bias setting process being applied to the development roller, for each of the first color, the second color, the third color, and the fourth color, and wherein the pattern images are displacement-corrective test images to be used for correcting displacements of images.

9. The image forming apparatus according to claim 1, wherein the image forming unit further comprises a belt as the transfer medium, and the image forming unit is configured to form a patch of toner of a predetermined color on the belt by transferring the patch from the photoconductor drum onto the belt, wherein the detector is configured to detect the patch formed on the belt, wherein the controller is configured to cause the image forming unit to form a preceding patch of the predetermined color on the belt and thereafter form a succeeding patch of the predetermined color on the belt in a position distanced upstream in the direction of movement of the belt from the preceding patch, in such a manner that the succeeding patch consists of a first part and a second part, the first part extending over a first region defined between a first position apart upstream from a leading edge of the preceding patch at a distance equal to a drum circumferential length that is a circumferential length of the photoconductor drum and a second position apart upstream from a trailing edge of the preceding patch at the distance equal to the drum circumferential length, and a leading edge or a trailing edge of the succeeding patch is located in the first region, while the second part is located outside the first region, and wherein the first part of the succeeding patch which extends over the first region has a length Lo in the direction of movement of the belt, the length Lo being equal to or shorter than 3 millimeters.

10. The image forming apparatus according to claim 9, wherein the controller is configured to cause the image forming unit to form the succeeding patch in such a manner that the trailing edge of the succeeding patch is located in the first region.

11. The image forming apparatus according to claim 10, wherein Lc1<Le1, where Lc1 is the drum circumferential length, and Le1 is a distance from the leading edge of the preceding patch to the trailing edge of the succeeding patch.

12. The image forming apparatus according to claim 1, wherein the image forming unit further comprises a belt as the transfer medium, and is configured to form a patch of toner of a predetermined color on the belt by transferring the patch from the photoconductor drum onto the belt, wherein the detector is configured to detect the patch formed on the belt, wherein the controller is configured to cause the image forming unit to form a preceding patch of the predetermined color on the belt and thereafter form a succeeding patch of the predetermined color on the belt in a position distanced upstream in the direction of movement of the belt from the preceding patch, in such a manner that the succeeding patch consists of a first part and a second part, the first part extending over a second region defined between a third position apart upstream from a leading edge of the preceding patch at a distance equal to a roller circumferential length that is a circumferential length of the development roller and a fourth position apart upstream from a trailing edge of the preceding patch at the distance equal to the roller circumferential length, and a leading edge or a trailing edge of the succeeding patch is located in the first region, while the second part is located outside the second region, and wherein the first part of the succeeding patch which extends over the second region has a length Lo in the direction of movement of the belt, the length Lo being equal to or shorter than 3 millimeters.

13. The image forming apparatus according to claim 12, wherein the controller is configured to cause the image forming unit to form the succeeding patch in such a manner that the trailing edge of the succeeding patch is located in the second region.

14. The image forming apparatus according to claim 13, wherein Lc2<Le2, where Lc2 is the roller circumferential length, and Le2 is a distance from the leading edge of the preceding patch to the trailing edge of the succeeding patch.

15. The image forming apparatus according to claim 9, wherein the patch of toner is the first bias-corrective test image or the second bias-corrective test image formed in the bias-corrective test image forming process.

16. The image forming apparatus according to claim 12, wherein the patch of toner is the first bias-corrective test image or the second bias-corrective test image formed in the bias-corrective test image forming process.

17. An image forming apparatus comprising:

an image forming unit configured to form a toner image on a transfer medium, the image forming unit comprising four sets of a photoconductor drum and a development roller, the four sets consisting of a first set for forming a toner image of a first color, a second set for forming a toner image of a second color, a third set for forming a toner image of a third color, and a fourth set for forming a toner image of a fourth color, a detector configured to detect a toner image formed on the transfer medium passing by the detector; and a controller, wherein the photoconductor drums for the first, second, third and fourth colors are arranged in this order, in a direction opposite to a direction of movement of the transfer medium moving toward the detector, wherein the controller is capable of executing, for each of the first color, the second color, the third color, and the fourth color:

a bias-corrective test image forming process of causing the image forming unit to form a first bias-corrective test image on the transfer medium with a first developing bias being applied to the development roller, and to form a second bias-corrective test image on the transfer medium with a second developing bias being applied to the development roller, the second developing bias having a value different from a value of the first developing bias;

a bias setting process of setting a developing bias based on outputs of the detector as generated upon detection of the first bias-corrective test image and the second bias-corrective test image; and a pattern image forming process of causing the image forming unit to form a plurality of pattern images on the transfer medium with the developing bias set in the bias setting process being applied to the development roller, wherein the controller is configured to execute the bias-corrective test image forming process and the pattern image forming process in such a manner that:

a color of a frontmost first bias-corrective test image that is located frontmost among a first set of images consisting of the first bias-corrective test images of respective colors and the second bias corrective test images of the respective colors, and a color of a frontmost pattern image that is located frontmost among a second set of images consisting of the pattern images of the respective colors are the first color; and a color of a rearmost second bias-corrective test image that is located rearmost among the first set of images and a color of a rearmost pattern image that is located rearmost among the second set of images are different from each other.

18. The image forming apparatus according to claim 17, wherein the controller is configured to execute the bias-corrective test image forming process in such a manner that a second bias-corrective test image of the first color is arranged in a position downstream of one of other three first bias-corrective test images of the second, third, and fourth colors in the direction of movement of the transfer medium.

* * * * *